US010252536B2

(12) United States Patent
Nakata et al.

(10) Patent No.: US 10,252,536 B2
(45) Date of Patent: Apr. 9, 2019

(54) RECORDING APPARATUS

(71) Applicant: SEIKO EPSON CORPORATION, Tokyo (JP)

(72) Inventors: Satoshi Nakata, Matsumoto (JP); Katsunari Kumagai, Okaya (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/441,069

(22) Filed: Feb. 23, 2017

(65) Prior Publication Data

US 2017/0246871 A1 Aug. 31, 2017

(30) Foreign Application Priority Data

Feb. 26, 2016 (JP) ..... 2016-035342
Jun. 20, 2016 (JP) ..... 2016-121439

(51) Int. Cl.
*B41J 25/34* (2006.01)
*B41J 2/175* (2006.01)
*B41J 29/02* (2006.01)

(52) U.S. Cl.
CPC ..... *B41J 2/1752* (2013.01); *B41J 2/1753* (2013.01); *B41J 2/17546* (2013.01); *B41J 2/17553* (2013.01); *B41J 25/34* (2013.01); *B41J 29/02* (2013.01)

(58) Field of Classification Search
CPC ..... B41J 2/175; B41J 2/1752; B41J 2/17526; B41J 2/17546; B41J 25/34
See application file for complete search history.

(56) References Cited

U.S. PATENT DOCUMENTS 5,619,237 A * 4/1997 Inoue ..... B41J 2/17503 347/86
6,286,932 B1 9/2001 Hirano
6,520,625 B1 * 2/2003 Kawakami ..... B41J 25/34 347/49
6,779,880 B1 * 8/2004 Kulpa ..... B41J 2/1752 222/325
6,948,798 B2 * 9/2005 Kline ..... B41J 2/175 347/49
7,562,958 B2 * 7/2009 Asauchi ..... B41J 2/17526 347/19
8,721,059 B2 * 5/2014 Kodama ..... B41J 2/1752 347/50
9,707,770 B2 * 7/2017 Powell ..... B41J 2/1752

* cited by examiner

*Primary Examiner* — Anh T Vo
(74) *Attorney, Agent, or Firm* — Workman Nydegger

(57) ABSTRACT

A recording apparatus is provided with a carriage that includes a recording head for recording on a medium and that is movable in a predetermined direction. The carriage includes plural cartridges that are removable and contain liquids to be ejected from the recording head, and an operating portion that performs operation to release fixation of the ink cartridges to the carriage. The ink cartridges are provided in the carriage to be arranged in a direction crossing a moving direction of the carriage, and the operating portion is located outside the ink cartridges in the moving direction of the carriage.

10 Claims, 20 Drawing Sheets

RECORDING APPARATUS

BACKGROUND

1. Technical Field

The present invention relates to a recording apparatus for recording on a medium.

2. Related Art

A serial ink jet printer is an example of recording apparatus in which a liquid (e.g., ink) is ejected at a medium from a recording head for recording while a carriage on which the recording head is mounted reciprocates in a main scanning direction.

In a serial ink jet printer in which plural ink cartridges are mounted on a carriage, the ink cartridges are generally arranged in the carriage along a direction in which the carriage moves. Some serial ink jet printers reduce their sizes in the width direction by arranging the ink cartridges along a direction crossing the direction in which the carriage moves as disclosed in U.S. Pat. No. 6,286,932.

In some ink jet printers, a storage medium is provided in an ink cartridge and information about the ink cartridge (color, a residual amount of ink, etc.) can be kept in the storage medium. The storage medium provided in the ink cartridge is in contact with a contact point provided in a carriage, and a control unit of a printer main body reads information from and writes information in the storage medium provided in the ink cartridge.

The control unit of the printer main body often accesses the storage medium provided in the ink cartridge with the carriage located (stopped) at an end portion in a moving range, more specifically, at a home position. If the ink cartridge is removed when information is being read from or written in the storage medium provided in the ink cartridge, a reading error or a writing error may be caused and, further, damage to a circuit board may be caused.

SUMMARY

An advantage of some aspects of the invention is to provide a recording apparatus of which size can be reduced by arranging ink cartridges in a direction crossing a direction in which a carriage moves, and in which removal of the ink cartridges can be prevented or reduced while a storage medium provided in each of the ink cartridges is being accessed.

A recording apparatus according to an aspect of the invention includes a carriage that includes a recording head for recording on a medium and that is movable in a predetermined direction. In this aspect, the carriage includes plural ink cartridges that are removable and contain liquids to be ejected from the recording head, and an operating portion that performs operation to release fixation of the ink cartridges to the carriage. In this aspect, the ink cartridges are provided in the carriage to be arranged in a direction crossing a moving direction of the carriage, and the operating portion is located outside the ink cartridges in the moving direction of the carriage.

According to this aspect, since the plural ink cartridges are provided to be arranged in the carriage in the direction crossing the moving direction of the carriage (arranged along the direction crossing the moving direction of the carriage), the size in the width direction can be reduced and, since the operating portion is located outside the ink cartridges in the moving direction of the carriage, in a state where the carriage is located at an end portion of a moving region, a space for a user operating the operating portion becomes small. That is, in a state where the carriage is located at the end portion of the moving region, it is difficult for the user to operate the operating portion. Therefore, removal of the ink cartridges at improper timing can be prevented or reduced.

In this case, a housing including the carriage thereinside has a cover portion that covers an upper portion of the operating portion in a state where the carriage is located at an end portion of a moving region.

According to this aspect, since the housing including the carriage thereinside has the cover portion which covers the upper portion of the operating portion, when the carriage is located at the end portion of the moving region, in a state where the carriage is located at the end portion of the moving region, it is more difficult for the user to operate the operating portion. Therefore, effects of the first aspect described above can be obtained more reliably.

In this case, the operating portion and the cover portion are located at positions lower than a top portion of the ink cartridges.

According to this aspect, since the operating portion and the cover portion are located at lower positions than the top portion of the ink cartridges, an increase in the size in the apparatus height direction due to the cover portion can be avoided.

In this case, in a state where the carriage is located at an end portion of a moving region, a distance between an inner wall surface of a housing including the carriage thereinside and the operating portion is determined to prevent operations of the operating portion.

According to this aspect, since the distance between the inner wall surface of the housing including the carriage thereinside and the operating portion is determined to prevent operations of the operating portion in a state where the carriage is located at the end portion of the moving region, effects of the first aspect described above can be obtained more reliably.

In this case, the operating portion is provided on the side of a home position of the carriage.

According to this aspect, since the operating portion is provided on the side of the home position of the carriage, improper removal of the ink cartridges by the user when the carriage is located at the home position can be reduced.

In this case, the operating portion includes an upper surface and an inclined surface extending from the upper surface to the outside in the moving direction of the carriage and downward in an apparatus height direction. In this aspect, fixation of the ink cartridges to the carriage is released when the inclined surface is pressed. In this aspect, a length of the inclined surface is longer than a length of the upper surface in the direction crossing the moving direction of the carriage.

According to this aspect, in a configuration in which fixation of the ink cartridges to the carriage is released when the inclined surface of the operating portion is pressed, since the length of the inclined surface in the inclined direction is longer than the length of the upper surface in the moving direction of the carriage, it is possible to make the user recognize more clearly that the inclined surface is a portion to hook the finger on, and misoperations, such as pressing of the upper surface, by the user when releasing fixation of the ink cartridges can be reduced.

In this case, each of the ink cartridges includes a storage medium that holds information about the ink cartridge. In this aspect, a contact terminal which is in electrical contact with the storage medium in the carriage is disposed on the side of the operating portion in the moving direction of the carriage.

In this case, each of the ink cartridges includes a storage medium that holds information about the ink cartridge. In this aspect, the carriage includes a connecting portion to which a cable is connected. In this aspect, a contact terminal which is in electrical contact with the storage medium in the carriage is disposed on the side on which the connecting portion is provided in the moving direction of the carriage.

According to this aspect, since the carriage includes a connecting portion to which the cable is connected, and the contact terminal which is in electrical contact with the storage medium in the carriage is disposed on the side on which the connecting portion is provided in the moving direction of the carriage, a distance between the contact terminal and the connecting portion becomes short (that is, a wire length can be shortened) inside of the carriage, whereby the cost can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
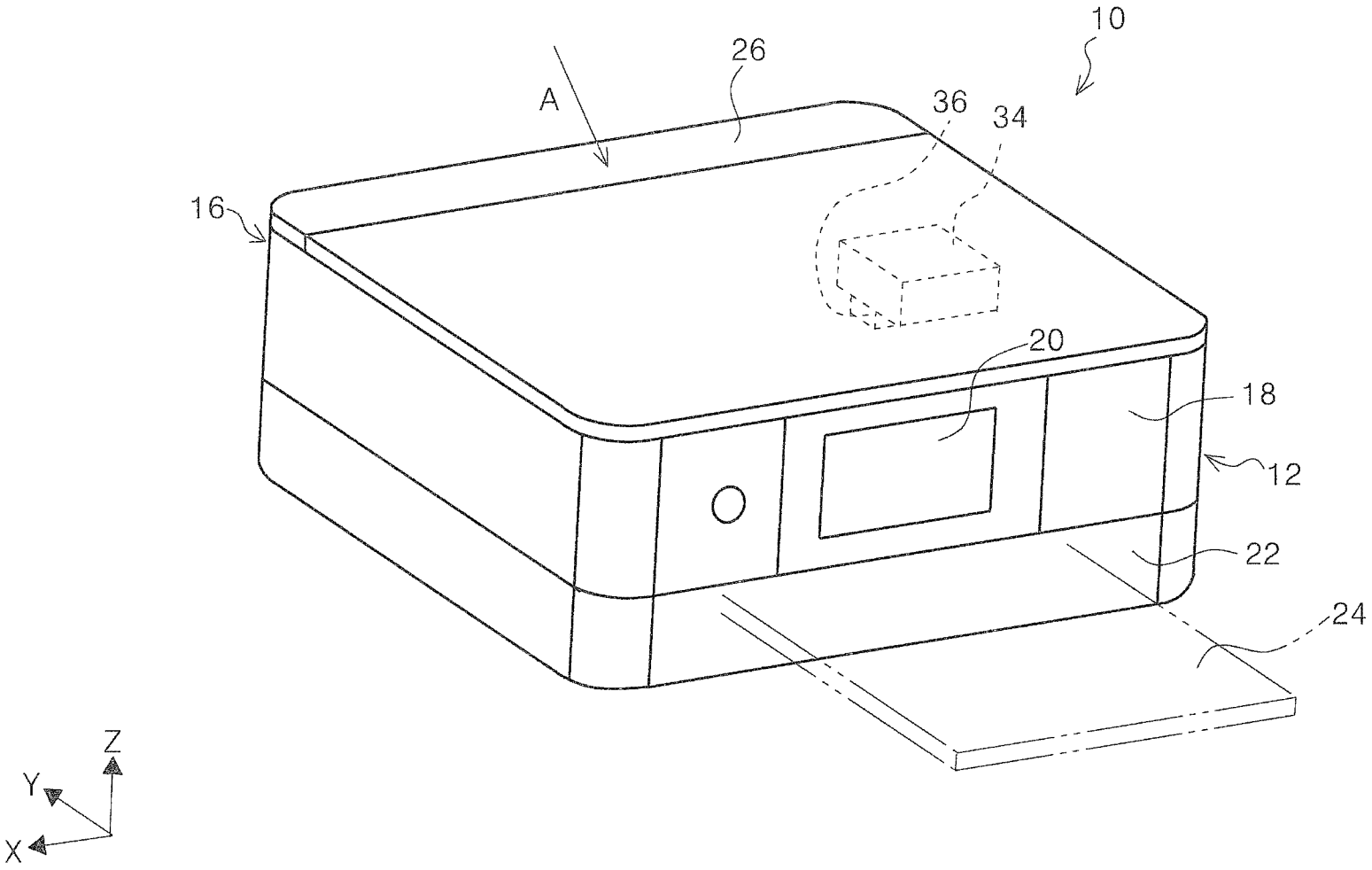
FIG. 1 is an exterior perspective view of a printer according to the invention.

Hereinafter, embodiments of the present invention will be described with reference to the drawings. In each embodiment, the same configuration is denoted by the same reference numeral, and is described in the first embodiment (i.e., not described in embodiments thereafter).

Figure 2:
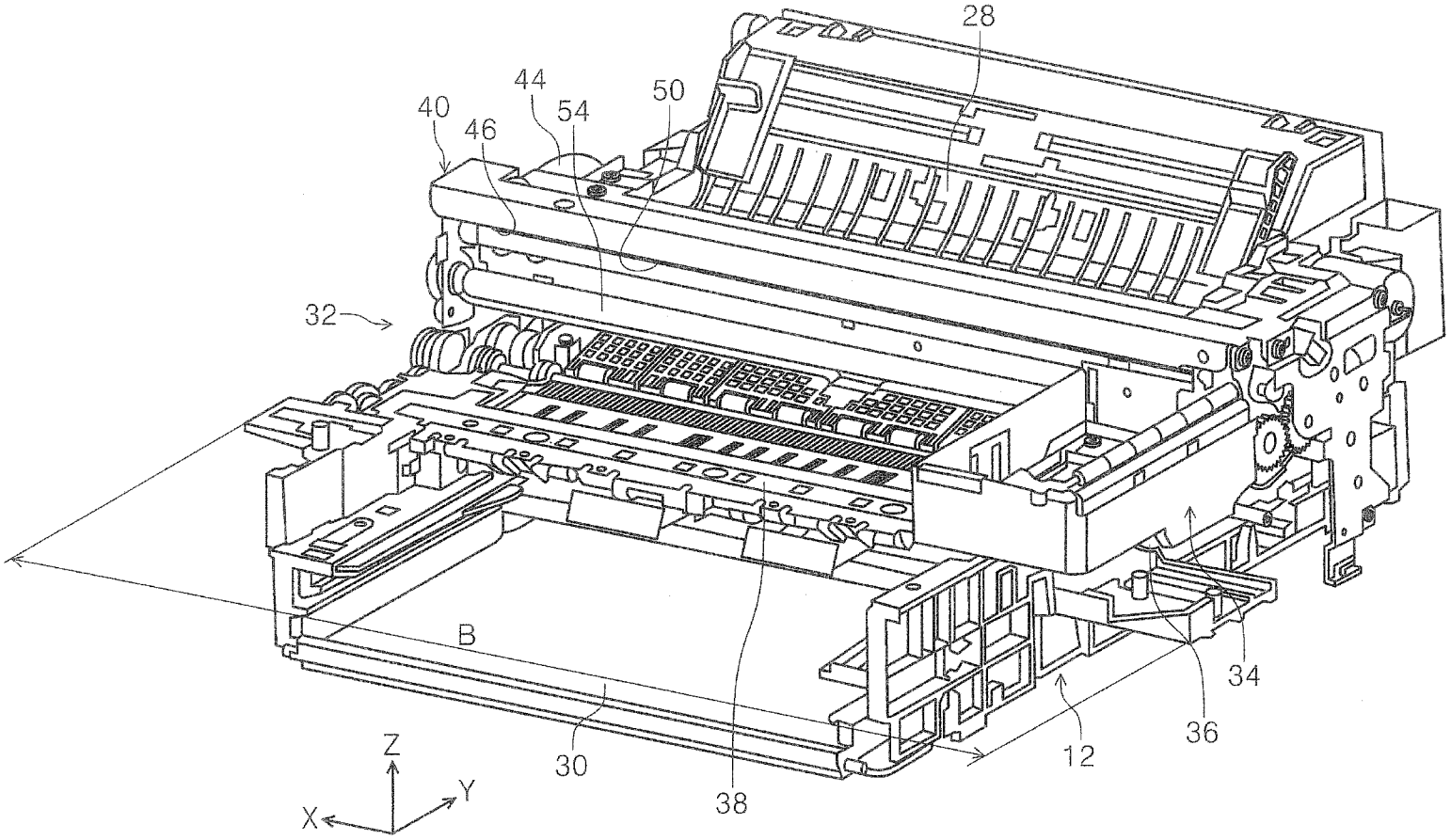
FIG. 2 is a perspective view of an apparatus main body of the printer according to the invention.
Figure 3:
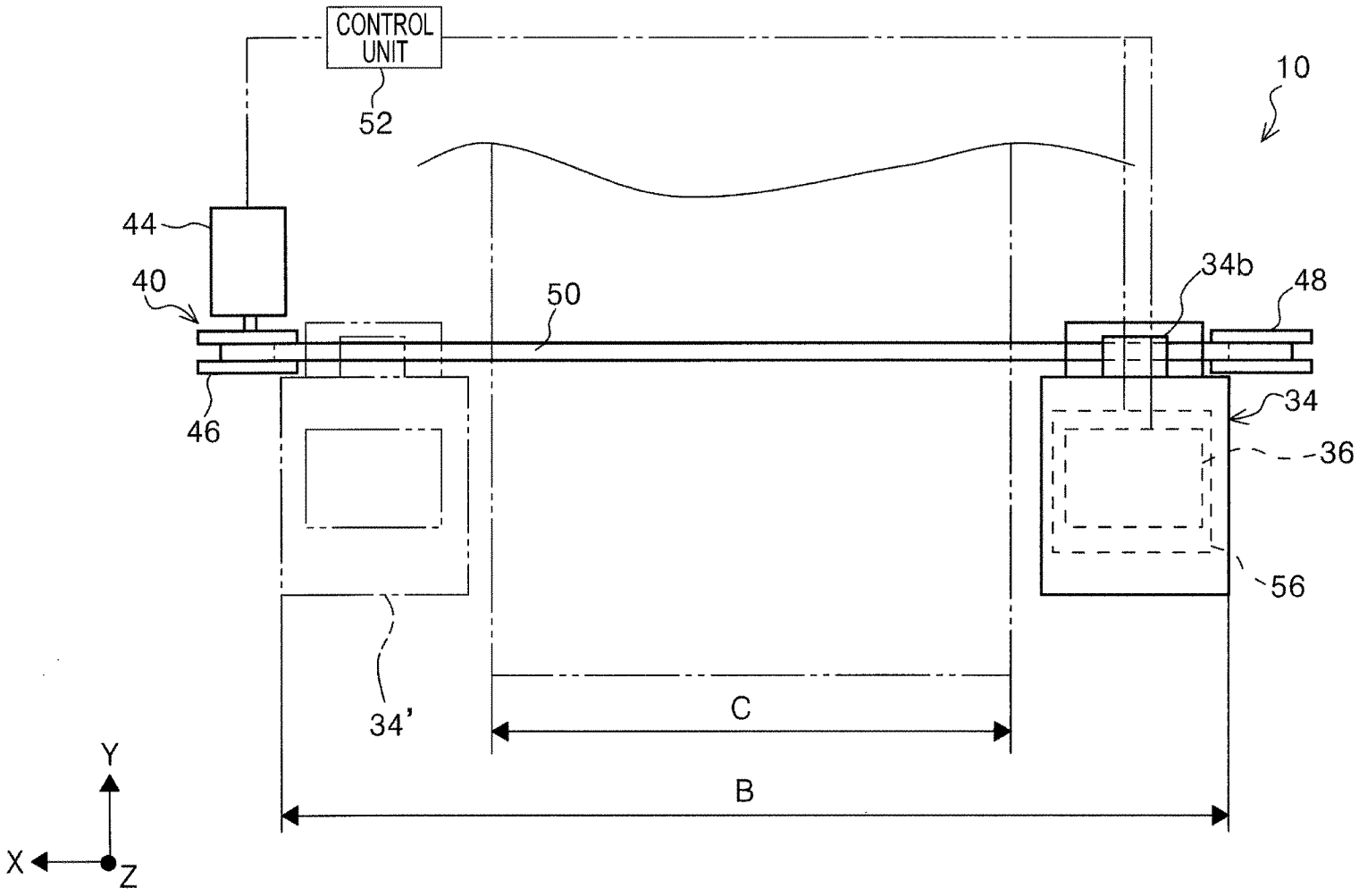
FIG. 3 is a schematic diagram illustrating a relationship between a carriage and a carriage driving unit according to the invention.
Figure 4:
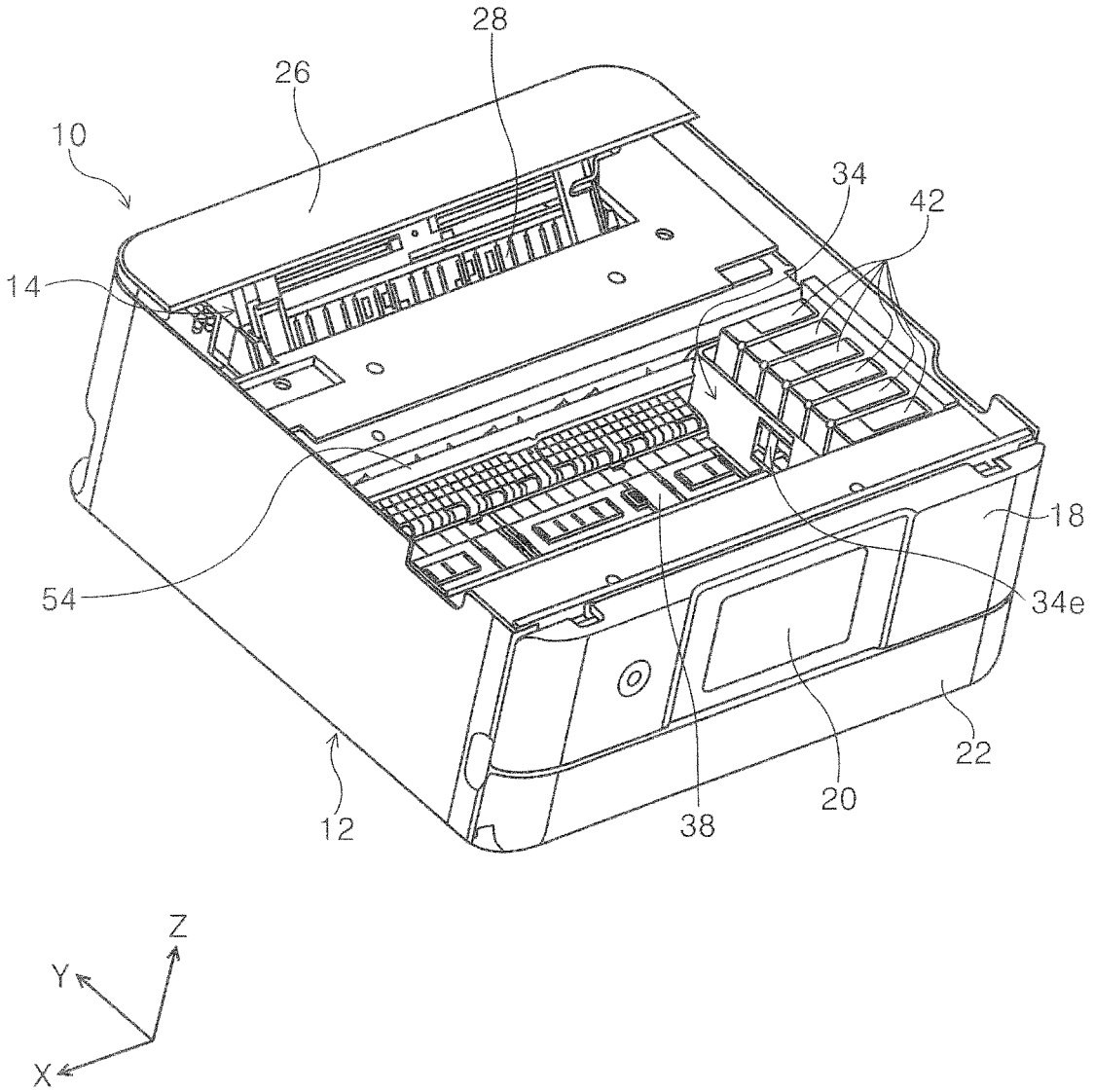
FIG. 4 is a perspective view of the printer with the carriage located at a home position.
Figure 5:
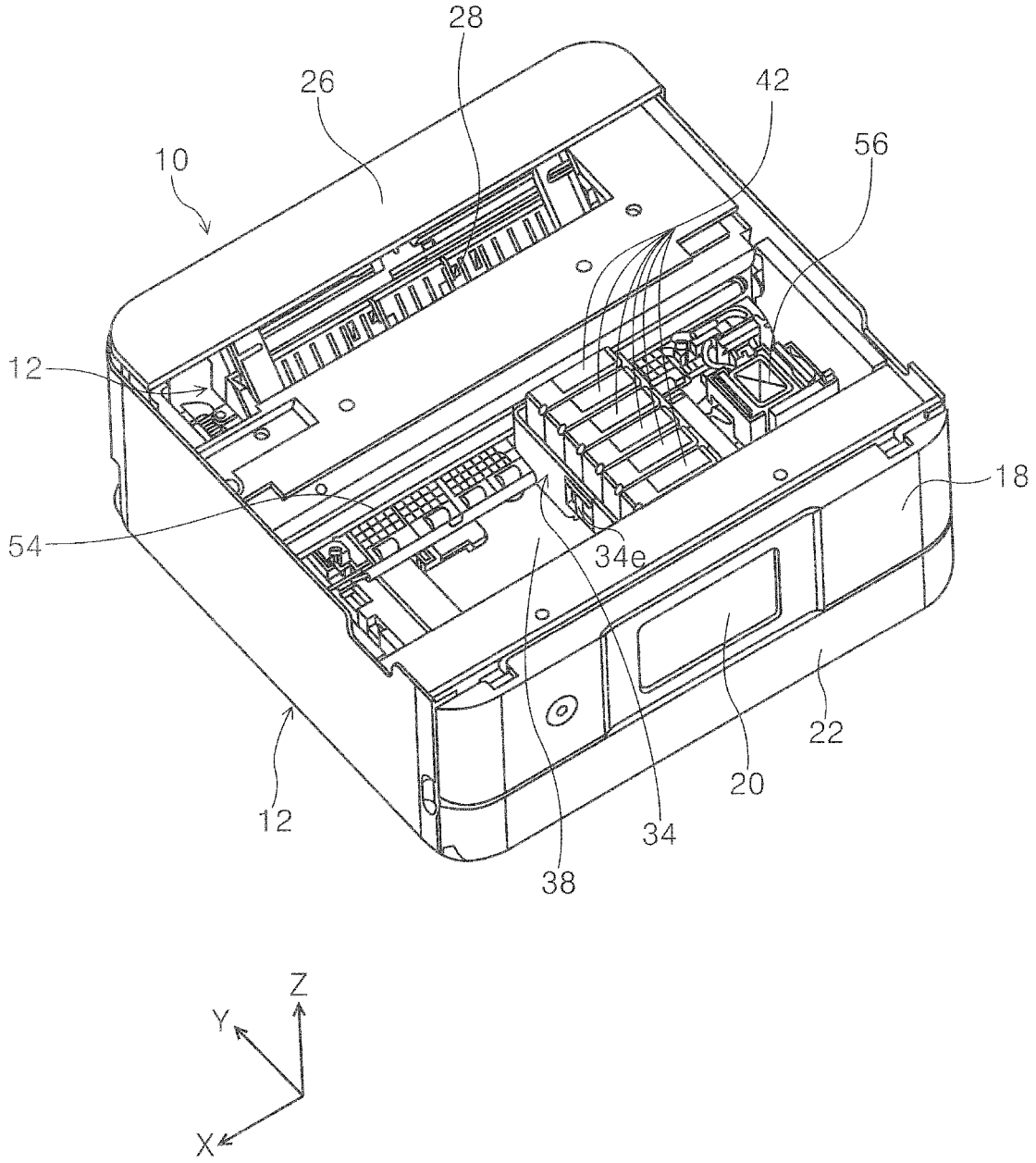
FIG. 5 is a perspective view of a cap in the printer.
Figure 6:
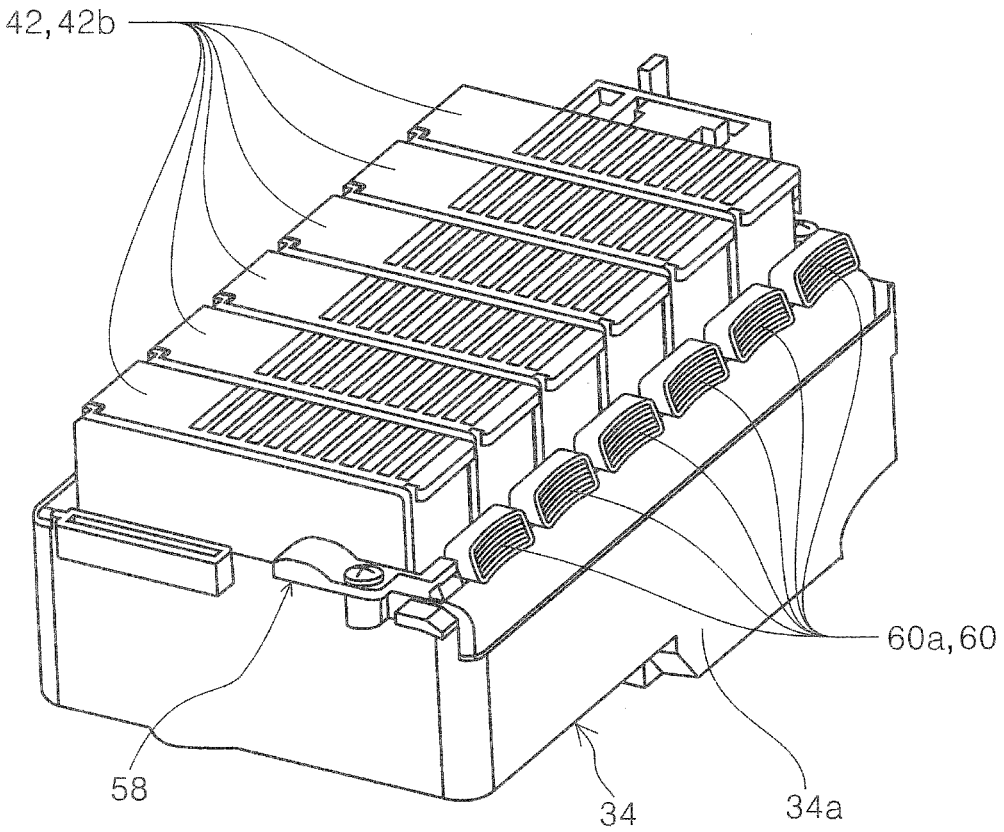
FIG. 6 is a perspective view of the carriage according to the invention.
Figure 6:
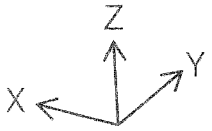

FIG. 1 is an exterior perspective view of a printer according to the invention. FIG. 2 is a perspective view of an apparatus main body of the printer according to the invention. FIG. 3 is a schematic diagram illustrating a relationship between a carriage and a carriage driving unit according to the invention. FIG. 4 is a perspective view of the printer with the carriage located at a home position. FIG. 5 is a perspective view of a cap in the printer. FIG. 6 is a perspective view of the carriage according to the invention.

Figure 7:
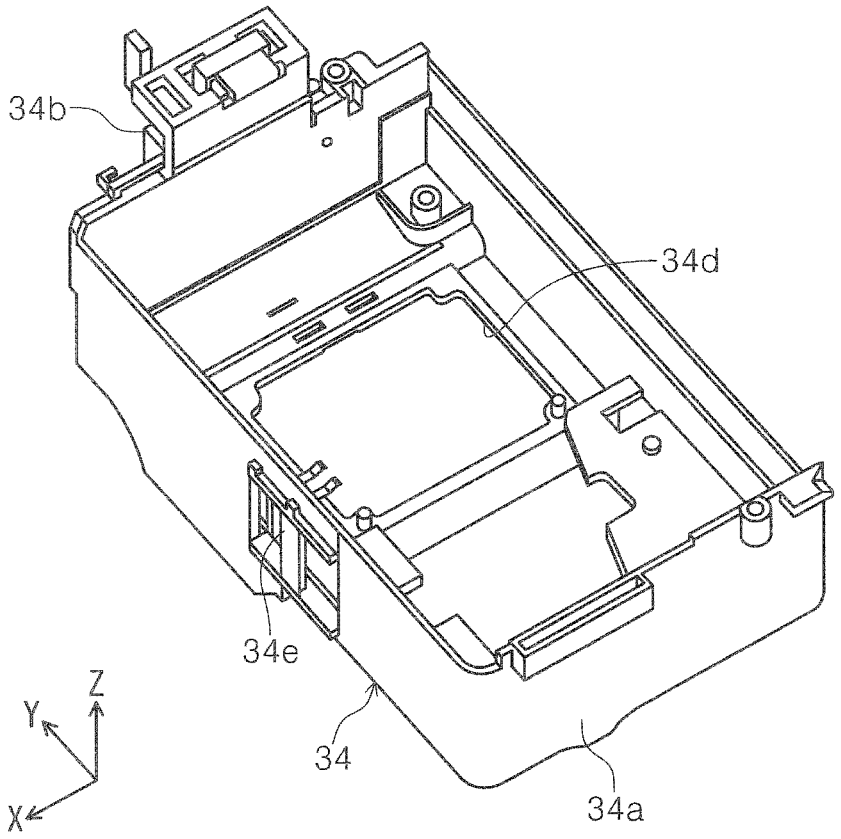
FIG. 7 is a perspective view of a housing of the carriage.
Figure 8:
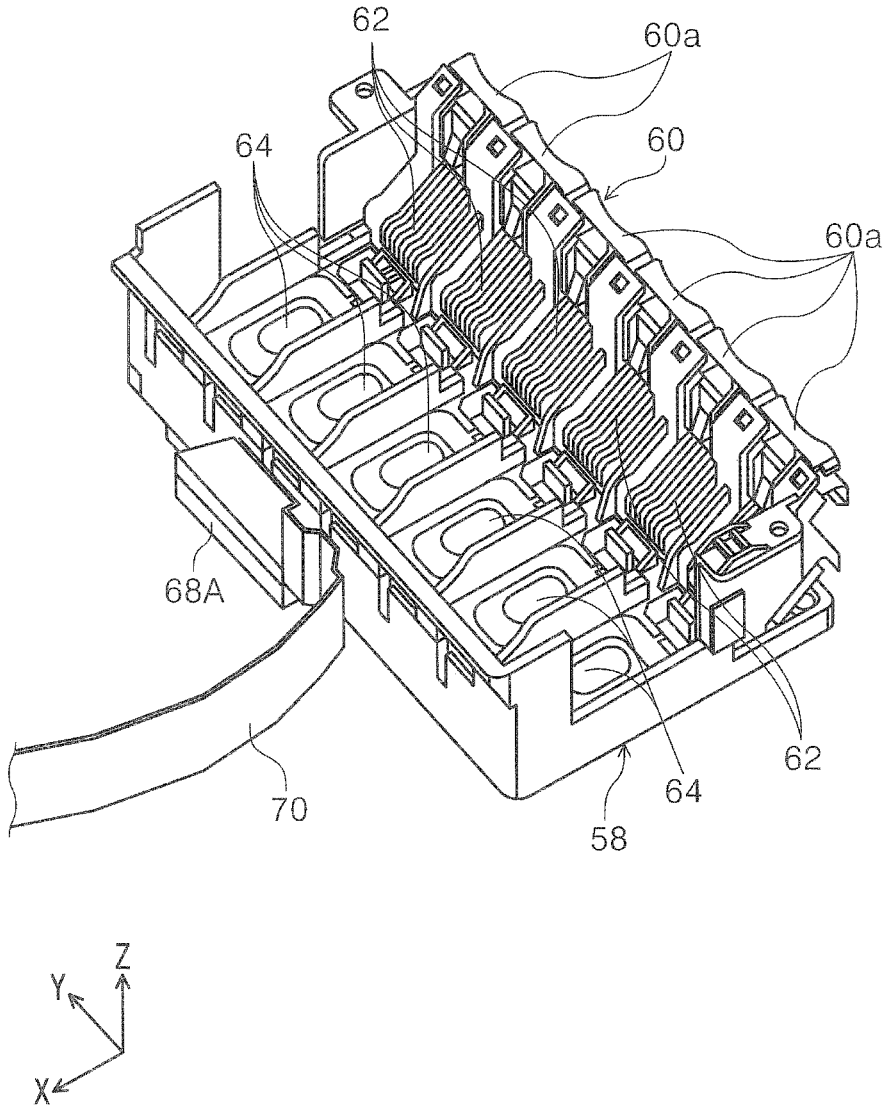
FIG. 8 is a perspective view of an attachment filter portion.
Figure 9:
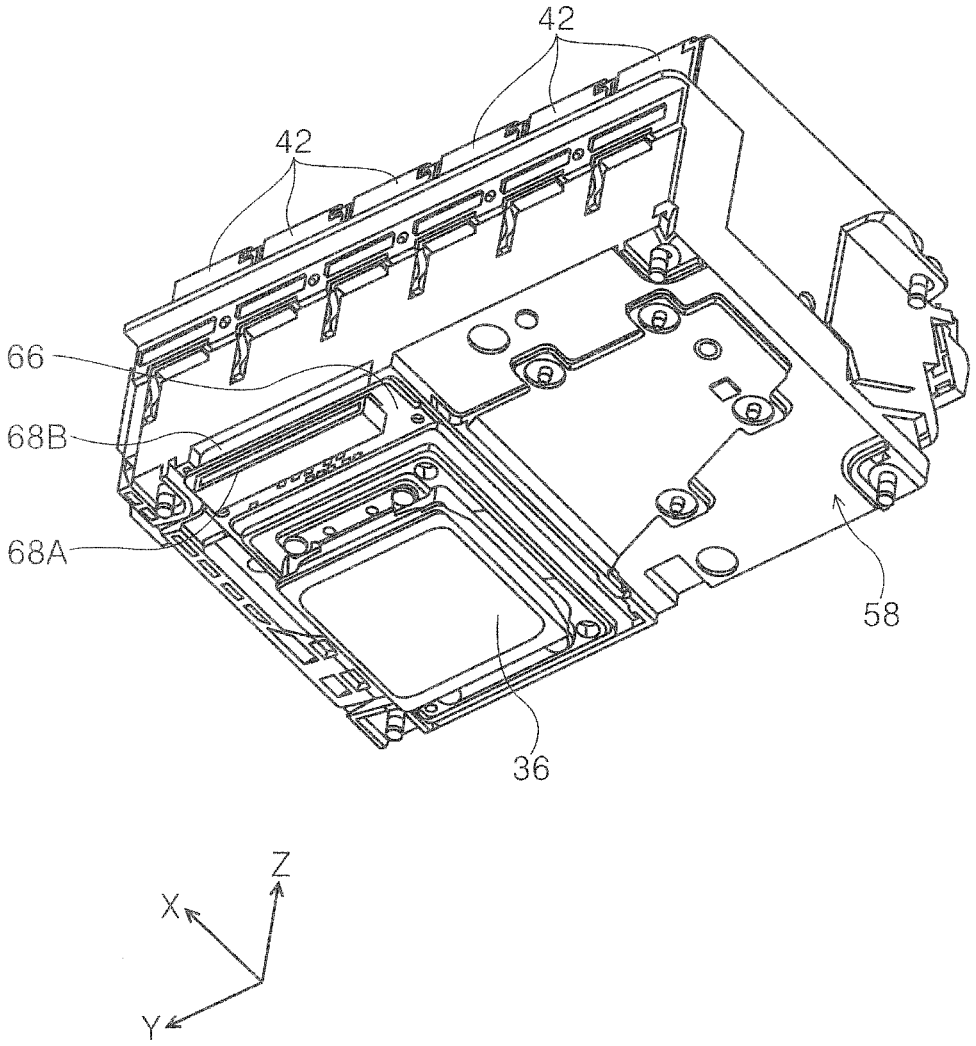
FIG. 9 is a perspective view of the attachment filter portion and a recording head.
Figure 10:
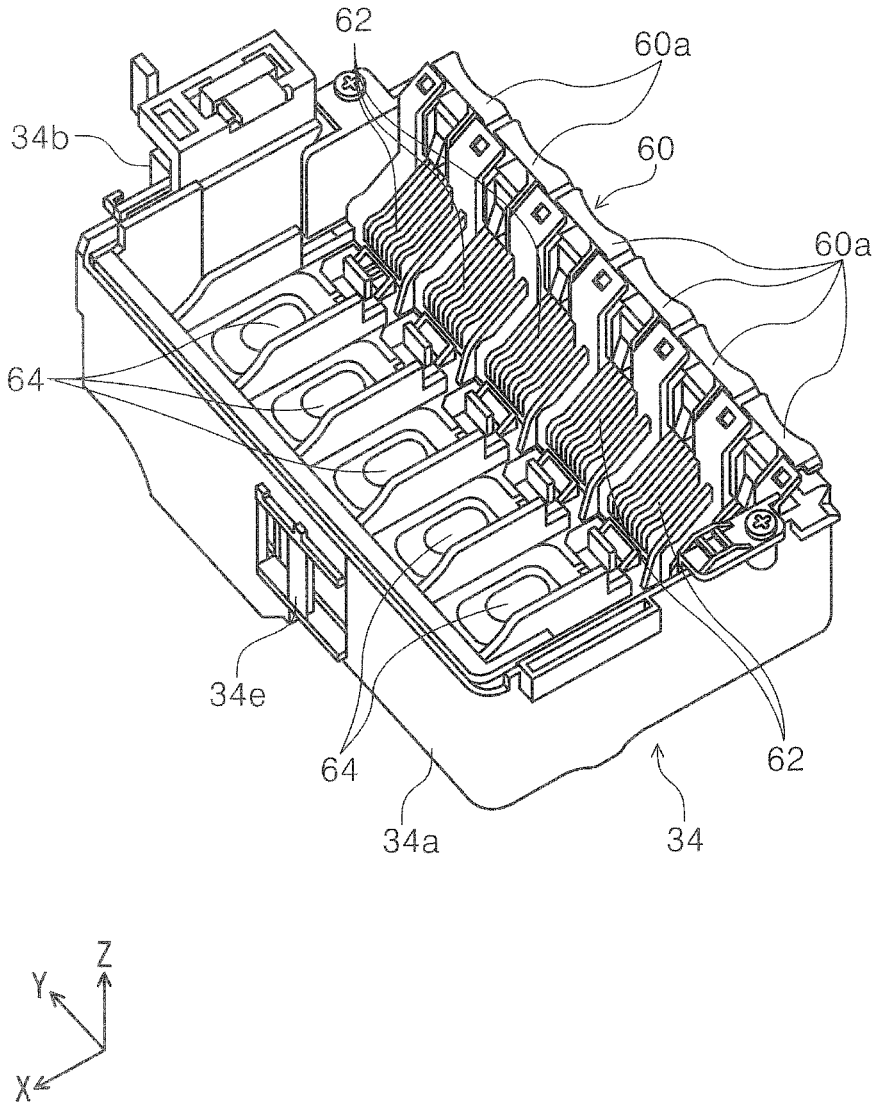
FIG. 10 is a perspective view of the carriage according to the invention with ink cartridges removed therefrom.
Figure 11:
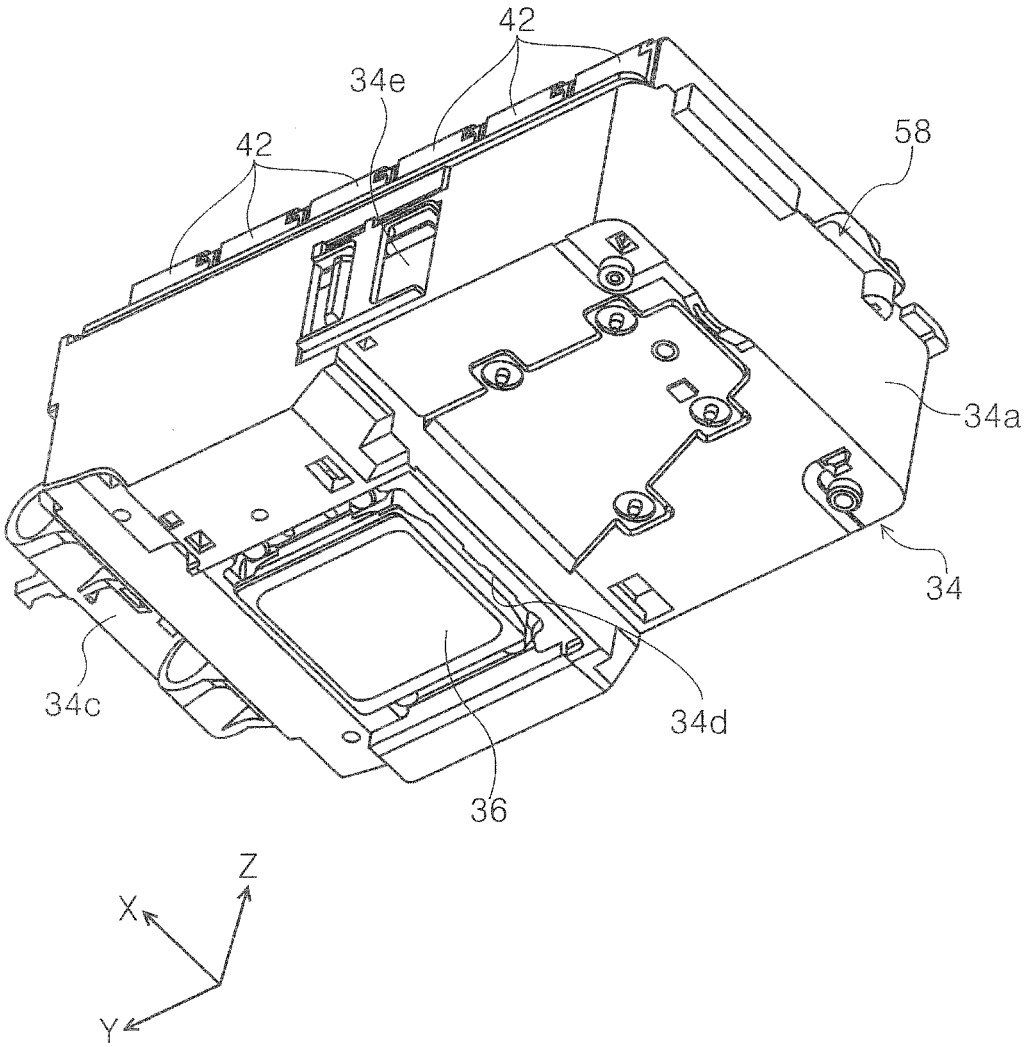
FIG. 11 is a perspective view of the recording head provided at a lower part of the carriage.
Figure 12:
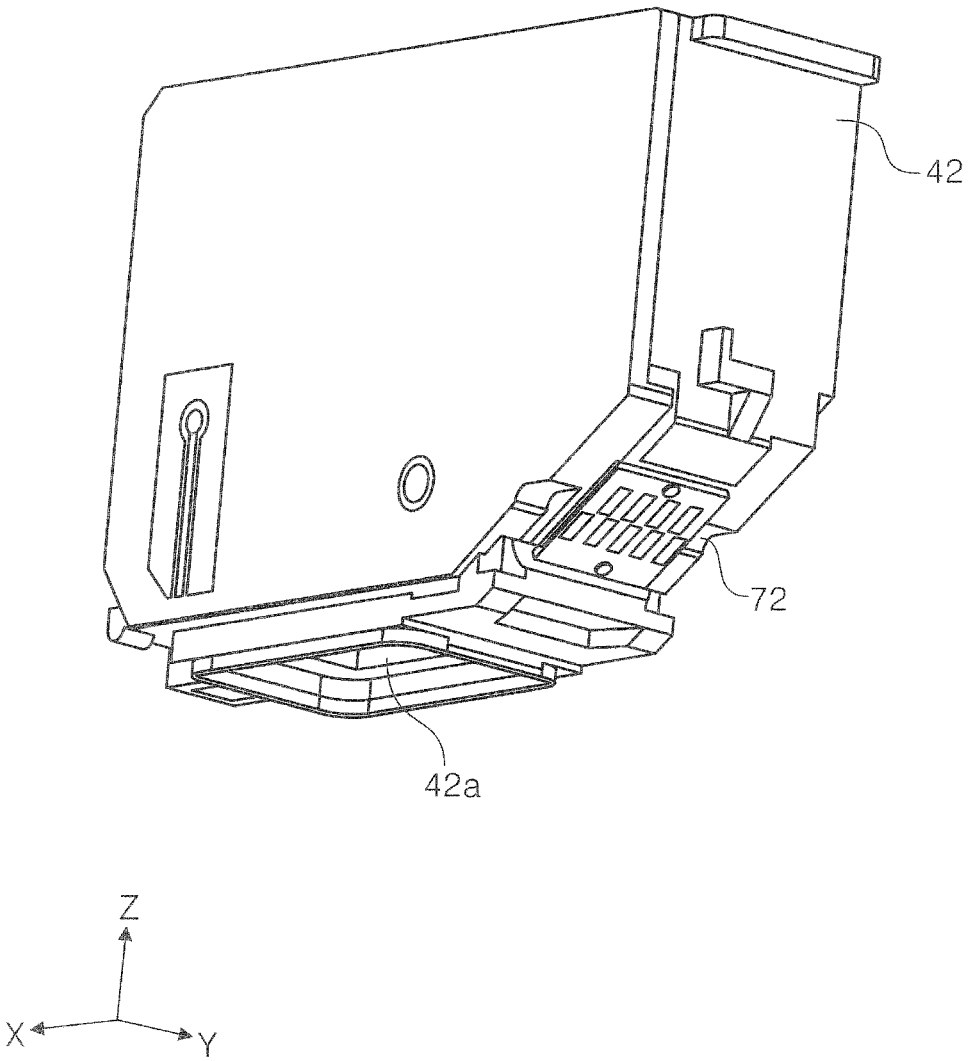
FIG. 12 is a perspective view of an ink cartridge.

FIG. 7 is a perspective view of a housing of the carriage. FIG. 8 is a perspective view of an attachment filter portion. FIG. 9 is a perspective view of the attachment filter portion and a recording head. FIG. 10 is a perspective view of the carriage according to the invention with ink cartridges removed therefrom. FIG. 11 is a perspective view of the recording head provided at a lower part of the carriage. FIG. 12 is a perspective view of an ink cartridge.

Figure 13:
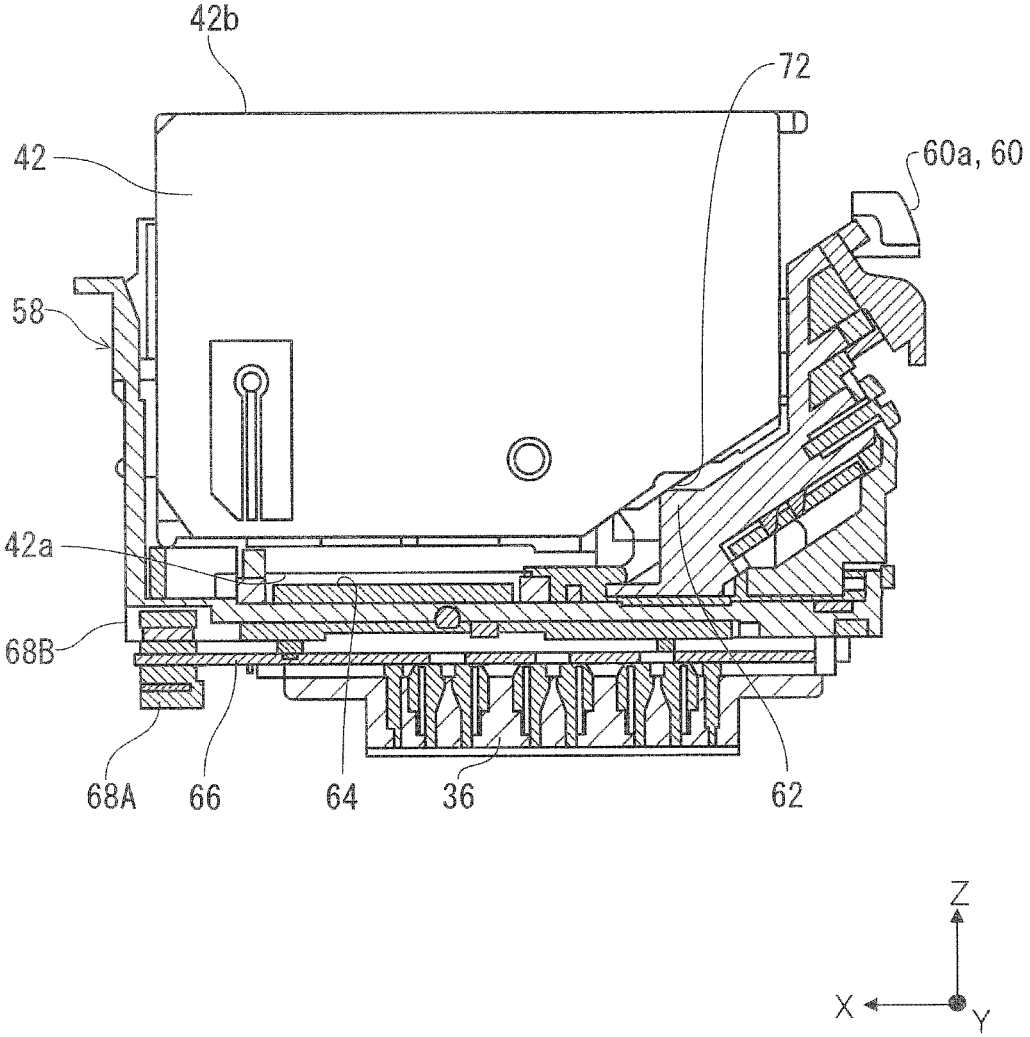
FIG. 13 is a transverse cross-sectional view of the attachment filter portion with the ink cartridges attached thereto.
Figure 14:
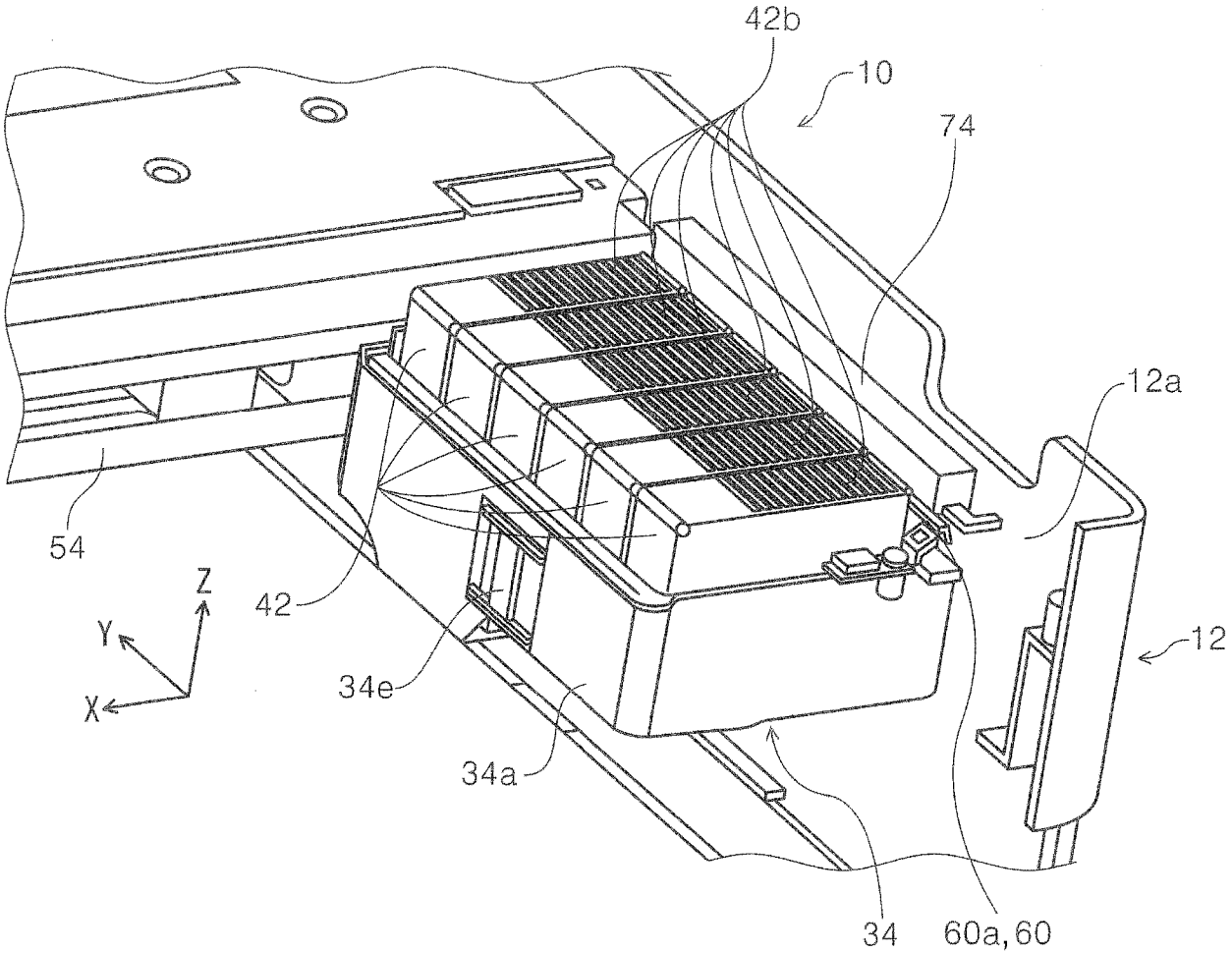
FIG. 14 is a perspective view illustrating a relationship between the carriage and the housing of the printer when the carriage is located at the home position.
Figure 15:
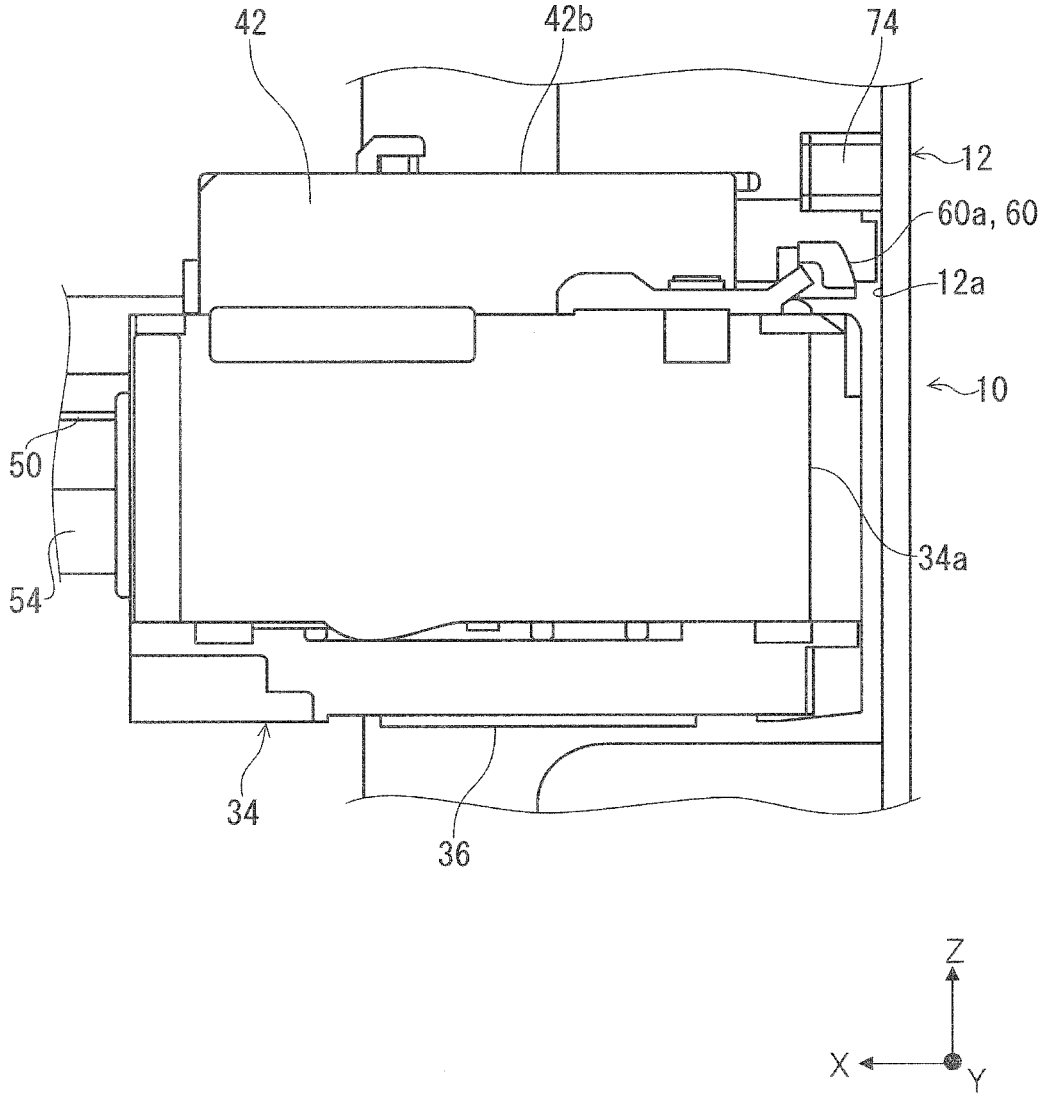
FIG. 15 is a front view illustrating a relationship between the carriage and the housing of the printer when the carriage is located at the home position.
Figure 16:
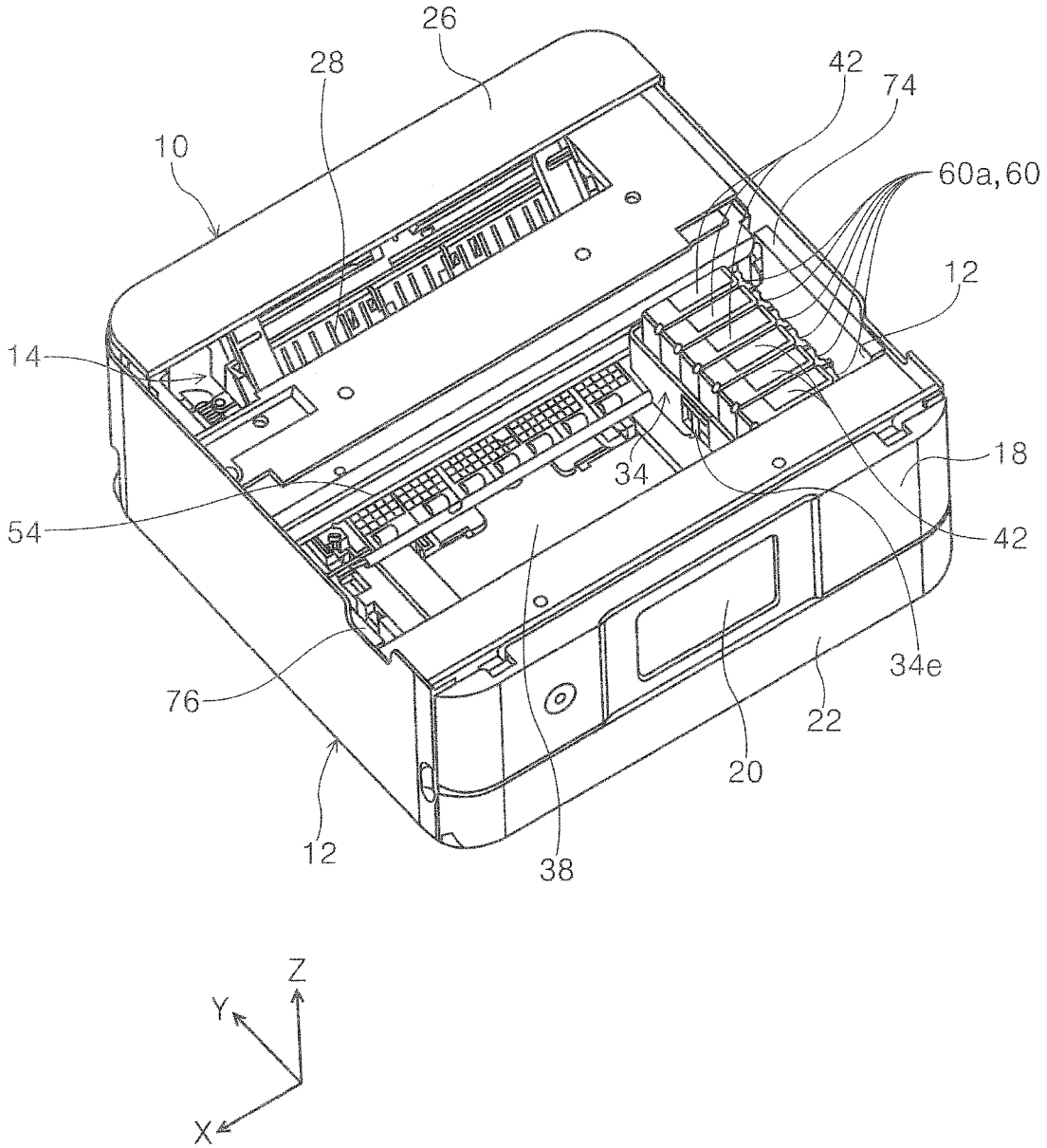
FIG. 16 is a perspective view of a state where the carriage is located at an ink cartridge replacement position in the printer.
Figure 17:
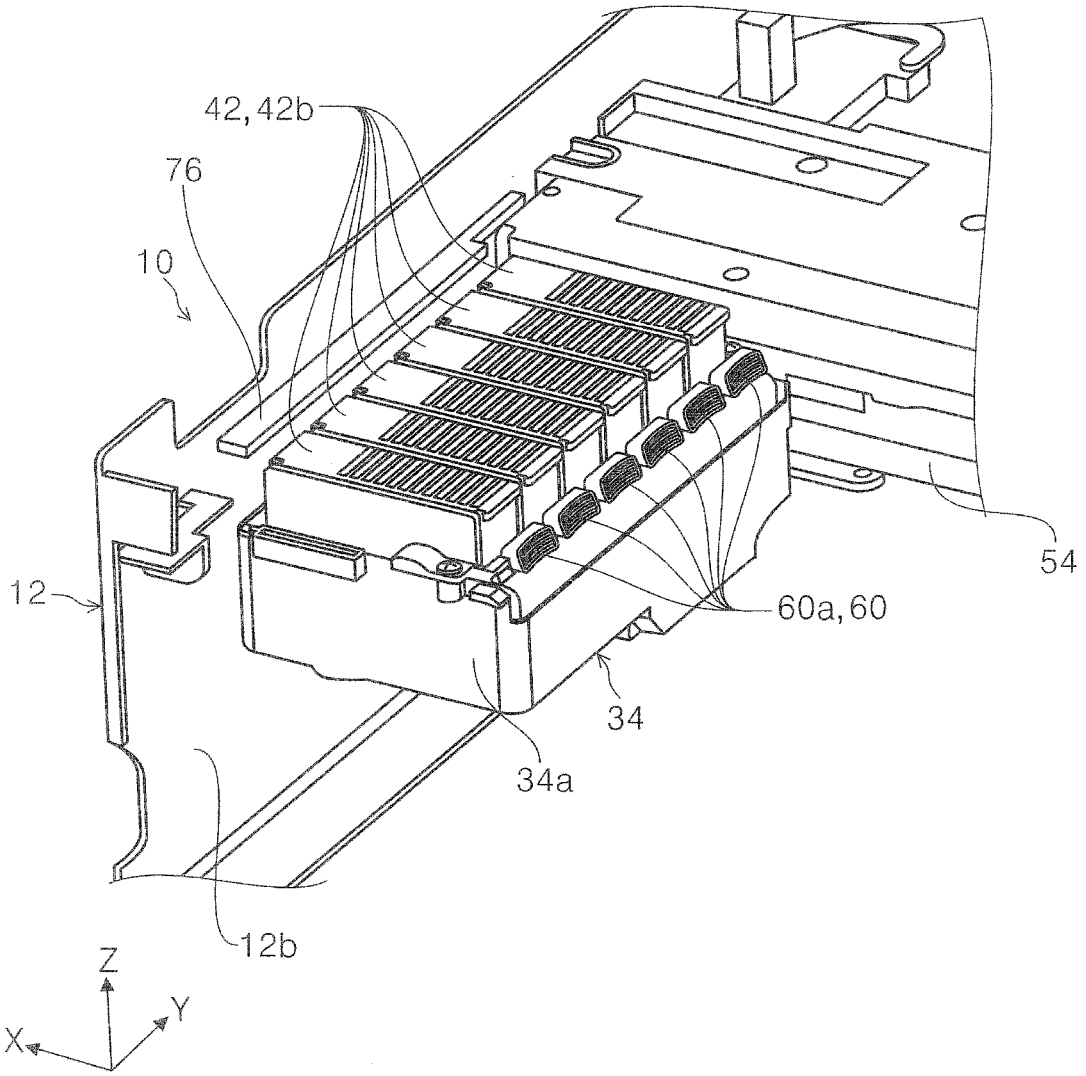
FIG. 17 is a perspective view illustrating a relationship between the carriage and the housing of the printer when the carriage is located at an end portion opposite to the home position.
Figure 18:
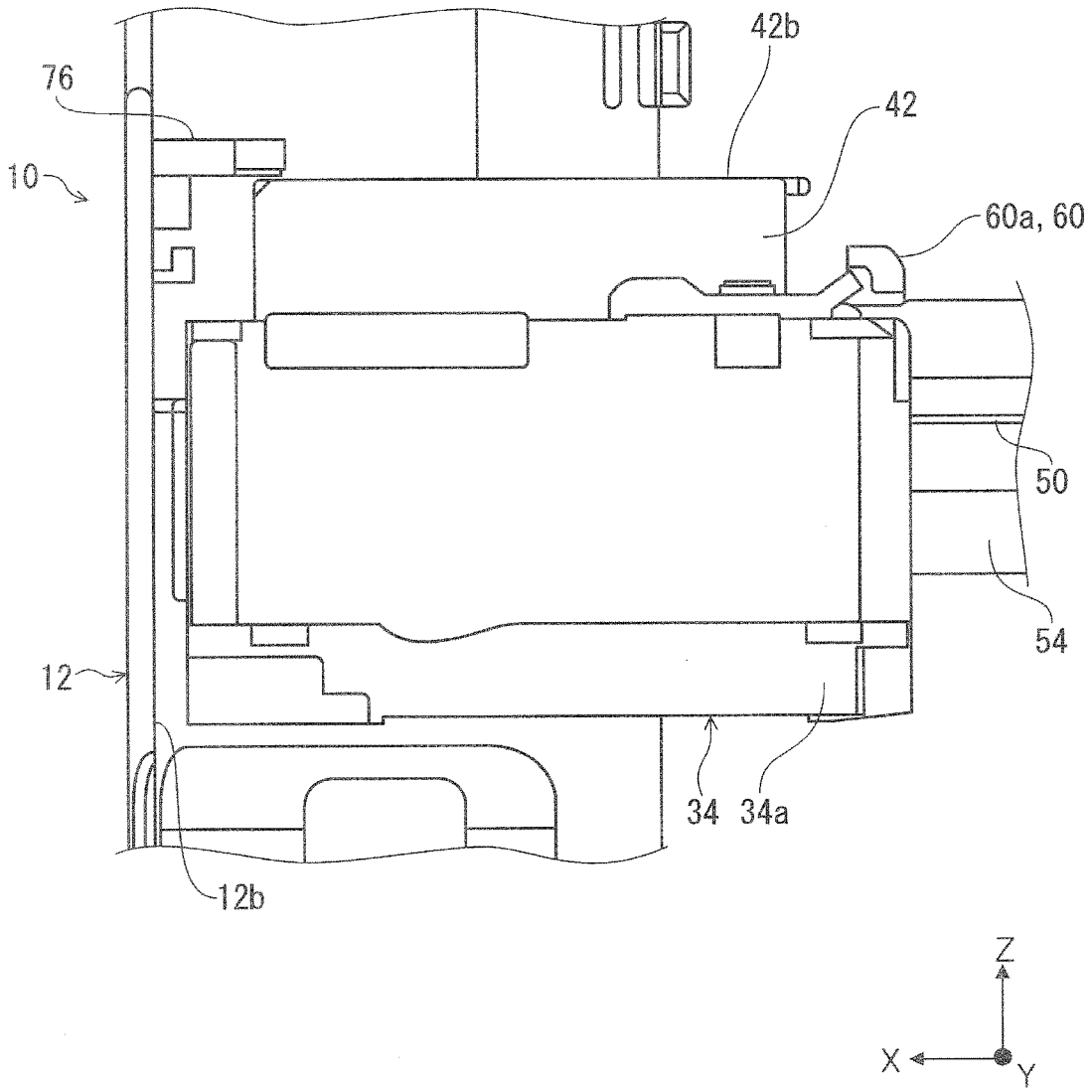
FIG. 18 is a front view illustrating a relationship between the carriage and the housing of the printer when the carriage is located at an end portion opposite to the home position.
Figure 19:
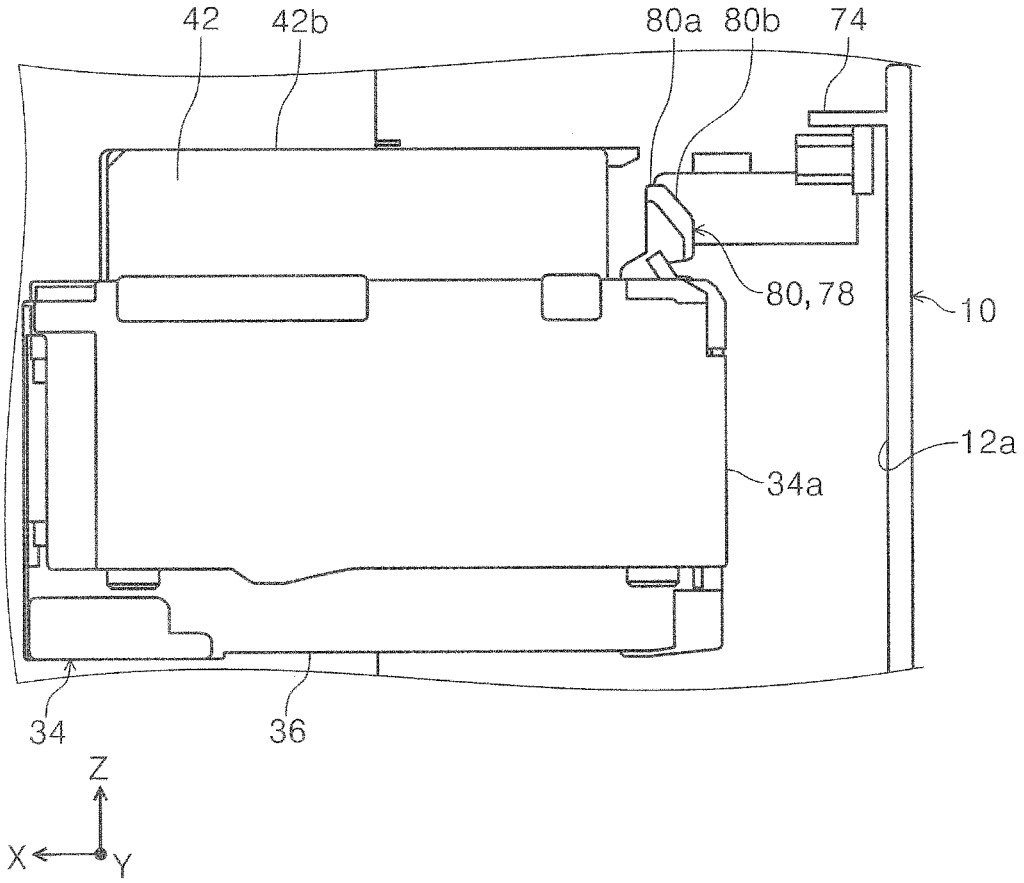
FIG. 19 is a front view illustrating a relationship between an operating portion and a housing of a printer according to a second embodiment.
Figure 20:
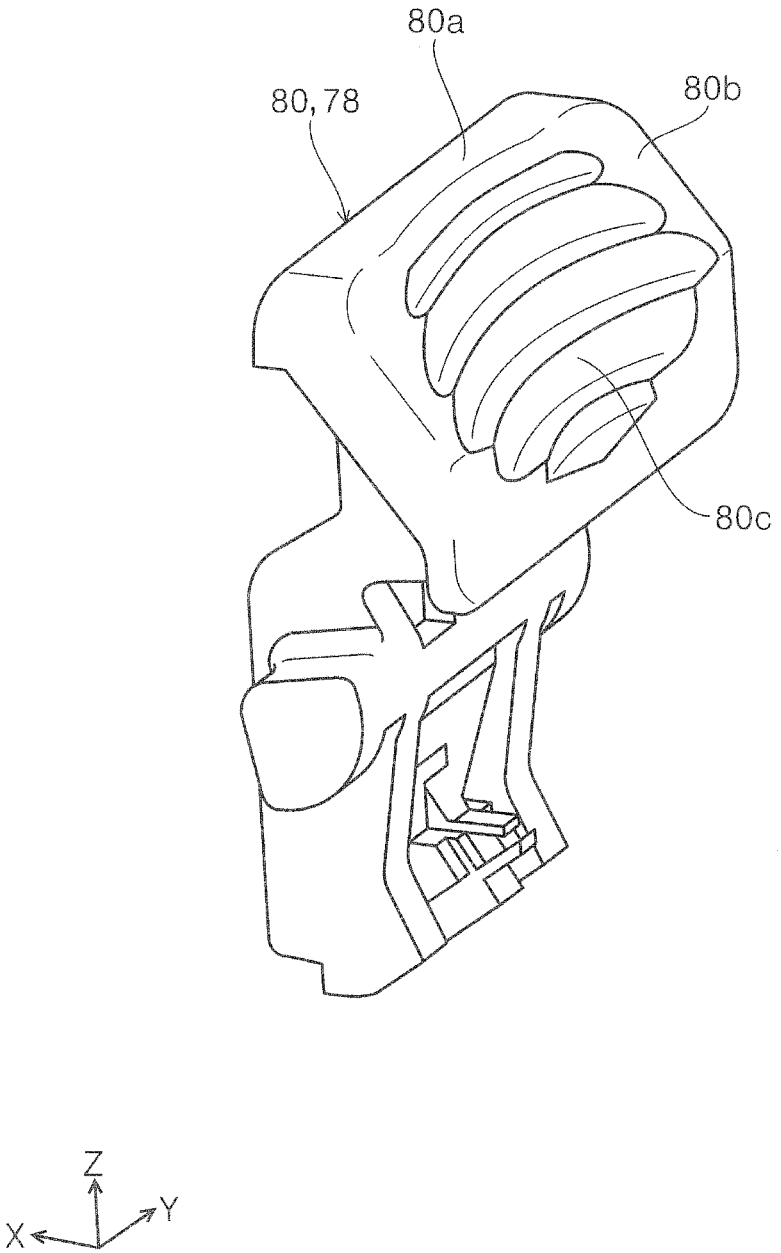
FIG. 20 is a perspective view of the operating portion according to the second embodiment.

FIG. 13 is a transverse cross-sectional view of the attachment filter portion with the ink cartridges attached thereto. FIG. 14 is a perspective view illustrating a relationship between the carriage and the housing of the printer when the carriage is located at the home position. FIG. 15 is a front view illustrating a relationship between the carriage and the housing of the printer when the carriage is located at the home position. FIG. 16 is a perspective view of a state where the carriage is located at an ink cartridge replacement position in the printer. FIG. 17 is a perspective view illustrating a relationship between the carriage and the housing of the printer when the carriage is located at an end portion opposite to the home position. FIG. 18 is a front view illustrating a relationship between the carriage and the housing of the printer when the carriage is located at an end portion opposite to the home position. FIG. 19 is a front view illustrating a relationship between an operating portion and a housing of a printer according to a second embodiment. FIG. 20 is a perspective view of the operating portion according to the second embodiment.

In an X-Y-Z coordinate system provided in each drawing, an X direction is a main scanning direction (a moving direction) of the carriage, i.e., a width direction of the recording apparatus, a Y direction is a depth direction of the recording apparatus, and a Z direction is an apparatus height direction. In each drawing, +X indicates an apparatus left side, −X indicates an apparatus right side, −Y indicates an apparatus front side, +Y indicates an apparatus back side, +Z indicates an apparatus upper side, and −Z indicates an apparatus lower side.

First Embodiment

Outline of Printer

As illustrated in FIGS. 1 and 2, a printer 10 includes a housing 12, an apparatus main body 14 which constitutes the inside of the housing 12 (see FIG. 2), and a scanner unit 16 provided in an upper part of the apparatus main body 14. In the present embodiment, the housing 12 constitutes an exterior of the apparatus main body 14. As illustrated in FIG. 1, an operation unit 18 is provided to be pivotable with respect to the housing 12 on the apparatus front side of the housing 12. A display 20, such as a display panel, is provided in the operation unit 18.

On the apparatus front side of the housing 12, a cover 22 is attached below the operation unit 18 to be pivotable with respect to the housing 12. A discharge tray 24 is provided in the apparatus main body 14. The discharge tray 24 can be retracted into the apparatus main body 14 and can be extended on the apparatus front side of the apparatus main body 14, i.e., the housing 12, (see a portion illustrated by a two-dot chain line in FIG. 1).

A cover 26 is pivotally attached to an upper portion on the back side of the housing 12. The cover 26 can take a closed position with respect to the housing 12 illustrated in FIG. 1, and an opened position (not illustrated) with respect to the housing 12. When the cover 26 is opened with respect to the housing 12, a medium can be inserted in the apparatus main body 14 inside the housing 12 in the direction of arrow A, and the inserted medium is guided by an inclined medium path guide 28 illustrated in FIG. 2 and sent to the downstream in a transport direction.

A medium container 30 which accommodates the medium is provided at a lower part of the apparatus main body 14 as illustrated in FIG. 2. In the present embodiment, the medium container 30 is removably attached to the apparatus main body 14 by opening the cover 22 with respect to the housing 12 from the apparatus front side.

A recording unit 32 is provided above the medium container 30 in the apparatus height direction. In the present embodiment, the recording unit 32 includes a carriage 34, a recording head 36, a medium guide member 38, and a carriage driving unit 40 (see FIG. 3). In the present embodiment, the carriage 34 can move reciprocatingly in the apparatus width direction. The recording head 36 (see FIG. 11) is provided below the carriage 34. In the present embodiment, the recording head 36 ejects ink as a "liquid" downward in the apparatus height direction.

In the present embodiment, the medium accommodated in the medium container 30 is fed by an unillustrated feeding unit to the downstream in the transport direction from the medium container 30, curved and inverted, and is transported toward the front side from the back side in the apparatus depth direction which is a medium transport direction. The medium is transported to the recording unit 32, where recording is performed on a recording surface of the medium. The medium is then discharged on the discharge tray 24 extended on the front side of the apparatus main body 14, i.e., the housing 12. The medium may also be inserted from the upper part of the printer 10 after opening the cover 26. The medium is guided to the medium path guide 28 and is transported to the recording unit 32, where recording is performed. After recording is performed, the medium is discharged on the discharge tray 24.

Outline of Carriage and Carriage Driving Unit

The carriage 34 and the carriage driving unit 40 will be described with reference to FIGS. 3 and 4. The carriage 34 includes a box-shaped housing 34*a*, a belt gripping portion 34*b*, and a bearing portion 34*c* (see FIG. 11). In the present embodiment, the housing 34*a* opens upward (see FIG. 10), and plural ink cartridges 42 (see FIG. 6) are removably attached to the housing 34*a*. The belt gripping portion 34*b* and the bearing portion 34*c* are provided integrally with the housing 34*a* on the back side of the housing 34*a*.

In the present embodiment, the carriage driving unit 40 includes a carriage driving motor 44, a driving pulley 46, a driven pulley 48, and a driving belt 50 as an example. An operation of the carriage driving unit 40 is controlled by a control unit 52 provided in the apparatus main body 14. Specifically, the control unit 52 controls the carriage driving unit 40 by controlling rotation of the carriage driving motor 44. In the present embodiment, the control unit 52 is constituted as an electric circuit provided with plural electronic parts. In the present embodiment, the control unit 52 controls an operation of a scanner unit 16 and a capping operation of a cap 56 as well as the transport operation of the medium and the operation of the carriage 34 in the printer 10.

In the present embodiment, the carriage driving motor 44 is provided on an apparatus left side of the apparatus main body 14 in the apparatus width direction. The driving pulley 46 is attached to the carriage driving motor 44. The driven pulley 48 is disposed on the apparatus right side of the apparatus main body 14 with a space between the driving pulley 46 and the driven pulley 48 in the apparatus width direction.

The driving belt 50 is wound around the driving pulley 46 and the driven pulley 48. The belt gripping portion 34*b* provided on the back side of the carriage 34 holds at least a part of the driving belt 50. When the control unit 52 drives the carriage driving motor 44 to rotate, the driving pulley 46 is also driven to rotate in the rotational direction of the carriage driving motor 44. The driving belt 50 is also driven in the same rotational direction.

Then, the carriage 34 is moved in the apparatus width direction by the carriage driving unit 40. In the present embodiment, the carriage 34 is reciprocable within a moving region B illustrated in FIG. 3 in the apparatus width direction. The moving region B is defined as a region between a right end portion and a left end portion in the apparatus width direction. That is, the carriage 34 can move in the apparatus width direction from a state illustrated by a two-dot chain line and denoted by the reference numeral 34' located on the left side in the apparatus width direction to a state illustrated by a solid line and denoted by the reference numeral 34 located on the right side in the apparatus width direction in FIG. 3. In the moving region B in the apparatus width direction, a recording region C is provided in which recording is performed on the medium transported to the recording unit 32 by the recording head 36.

A guide shaft 54 extending in the apparatus width direction is provided in the recording unit 32 as illustrated in FIGS. 2 and 4. In the present embodiment, the guide shaft 54 is inserted to penetrate the bearing portion 34*c* (see FIG. 11) provided on the back side of the carriage 34. When the carriage 34 moves in the apparatus width direction, the guide shaft 54 guides the carriage 34.

As illustrated in FIG. 3, in the present embodiment, the home position of the carriage 34 in the moving region B in the apparatus width direction is defined to be an end portion on the apparatus right side of the apparatus main body 14, i.e., a position apart from the recording region C. That is, when the carriage 34 is at its home position, the carriage 34 is located at the end portion on the apparatus right side in the housing 12 as illustrated in FIG. 4.

As illustrated in FIG. 5, the cap 56 is provided at the home position of the carriage 34 in the apparatus main body 14. The cap 56 faces the recording head 36 from below when the carriage 34 is located at the home position. When the carriage 34 is located at the home position, the cap 56 faces the recording head 36 and is pressed against the recording head 36 so as to seal a nozzle forming surface provided on a lower surface of the recording head 36 and prevent drying of ink.

Carriage

Next, a configuration of the carriage 34 will be described in more detail with reference to FIGS. 6 to 13. The carriage 34 includes the box-shaped housing 34*a* illustrated in FIG. 7 and an attachment filter portion 58 illustrated in FIG. 8. As illustrated in FIG. 7, an opening 34*d* is provided at a bottom portion of the box-shaped housing 34*a*. In the present embodiment, a cable outlet port 34*e* through which a later-described cable 70 is drawn out from the housing 34*a* is formed on a left side surface of the housing 34*a* in the apparatus width direction.

The attachment filter portion 58 is also formed in a box-shape as illustrated in FIGS. 8 and 9, and opens upward in the apparatus height direction. As illustrated in FIG. 8, an operating portion 60 is provided at the right end portion of the attachment filter portion 58 in the apparatus width direction. The operating portion 60 includes plural levers 60*a* in the present embodiment.

The plural levers 60*a* are arranged along the apparatus depth direction. In the attachment filter portion 58, plural contact terminals 62 and plural ink receiving ports 64 are provided. In the present embodiment, inside of the attachment filter portion 58 is divided along the apparatus depth direction corresponding to each lever 60*a*, and each division is provided with each contact terminal 62 and each ink receiving port 64. In the present embodiment, the lever 60*a*, the contact terminal 62, and the ink receiving port 64 are arranged in this order from the right to the left in the apparatus width direction.

As illustrated in FIG. 9, the recording head 36 is attached below the attachment filter portion 58 via a substrate 66. Each of the ink receiving ports 64 and the recording head 36 are connected by an unillustrated flow path. The ink supplied from each of the ink receiving ports 64 is supplied to the recording head 36 through the unillustrated flow path.

In the present embodiment, the substrate 66 attached below the attachment filter portion 58 extends over the entire width of the attachment filter portion 58 in the apparatus width direction. A first connecting portion 68A and a second connecting portion 68B as "connecting portions" are provided in the substrate 66. In the present embodiment, the first connecting portion 68A and the second connecting portion 68B are attached to the substrate 66 so that these connecting portions overlap in the apparatus height direction, i.e., vertically overlap each other (see FIG. 13). In the present embodiment, the first connecting portion 68A and the second connecting portion 68B are provided at the left end portion of the substrate 66 in the apparatus width direction.

In the present embodiment, as illustrated in FIG. 8, plural cables 70 are attached to the attachment filter portion 58. One end of the cable 70 is connected to the first connecting portion 68A and the second connecting portion 68B. Although not illustrated, the other end of the cable 70 is drawn around the outside of the carriage 34 through the cable outlet port 34*e* of the housing 34*a*, drawn around inside the apparatus main body 14 and connected to the control unit 52. In the present embodiment, the cable 70 is constituted as a flexible flat cable (FFC).

In the present embodiment, since the cable 70 extended from the first connecting portion 68A and the second connecting portion 68B provided at the left end portion of the substrate 66 in the apparatus width direction extends through the cable outlet port 34*e* provided on the left side surface of the housing 34*a* in the apparatus width direction, the cable 70 can be drawn at the shortest distance to the outside from the inside of the carriage 34, whereby the entire length of the cable 70 can be shortened.

As illustrated in FIGS. 10 and 11, the attachment filter portion 58 is attached to the housing 34*a* from above in the apparatus height direction. The recording head 36 provided below the attachment filter portion 58 is exposed at the lower part of the carriage 34 through the opening 34*d* of the housing 34*a*.

Each ink cartridge 42 is formed in a substantially rectangular parallelepiped shape as illustrated in FIG. 12. In the present embodiment, each of the ink cartridges 42 is filled with ink of black, magenta, cyan, yellow, etc.

An information storage portion 72 as a "storage medium" and an ink supply port 42*a* are provided at the lower part of the ink cartridge 42. In the present embodiment, the information storage portion 72 holds information about the ink cartridge 42. The information may be ink capacity and the color of the ink in the ink cartridge 42.

When the ink cartridge 42 is attached to the attachment filter portion 58, i.e., the carriage 34, as illustrated in FIG. 13, the information storage portion 72 and the contact terminal 62 are brought into contact and electrically connected with each other. In the present embodiment, although not illustrated, one end of the cable 70 is connected to the contact terminal 62 and extends to the outside of the carriage 34 through the cable outlet port 34*e* provided on the left side surface of the housing 34*a* in the apparatus width direction. The information about the ink cartridge 42 is transmitted to the control unit 52 via the contact terminal 62 and the cable 70 from the information storage portion 72.

The ink supply port 42*a* is closely attached to the ink receiving port 64, whereby supply of the ink from the ink cartridge 42 to recording head 36 becomes possible. As illustrated in FIG. 6, the plural ink cartridges 42 are arranged along the apparatus depth direction when attached to the carriage 34. The plural ink cartridges 42 are arranged so that the longitudinal direction of the substantially rectangular parallelepiped ink cartridges 42 corresponds to the moving direction of the carriage 34, i.e., the apparatus width direction.

By arranging the ink cartridges 42 in this manner, a display label representing the color of ink, etc. can be stuck on a top 42*b* of the ink cartridge 42 along the apparatus width direction, for example. As a result, since content to be displayed on the display label can be displayed laterally, various languages can be used and the displayed content can be easily read.

Since the ink cartridges 42 are arranged along the apparatus depth direction, when the number of colors of ink, i.e., the number of ink cartridges 42, is to be increased, it is unnecessary to change the length of members extending in the apparatus width direction, such as a frame member and the guide shaft 54, which constitute the apparatus main body 14. That is, the number of colors of ink can be increased or decreased while using the same members.

In the present embodiment, the size of the ink cartridge 42 in the apparatus width direction is determined to be, in the apparatus width direction, within the entire length of the substrate 66 attached below the attachment filter portion 58.

As illustrated in FIG. 6, in a state where the ink cartridges 42 are mounted on the carriage 34, the operating portion 60 is disposed outside the ink cartridges 42 in the apparatus width direction which is the moving direction of the carriage 34.

When the lever 60*a*, i.e., the operating portion 60, provided at the right end portion of the carriage 34 in the apparatus width direction is operated, a fixed state of the ink cartridge 42 with respect to the carriage 34 is released. When the ink cartridge 42 of which the fixed state has been released is moved upward in the apparatus height direction, the ink cartridge 42 is removed from the carriage 34 (see FIG. 10).

In a configuration in which the plural ink cartridges 42 are arranged along the apparatus width direction, for example, if variation occurs in the residual amounts of the ink in the ink cartridges 42, a centroid position of the carriage 34 may be moved in the apparatus width direction. If the centroid position of the carriage 34 is moved in the apparatus width direction, there is a possibility that swing (left and right tilt in the apparatus width direction) of the carriage 34 occurs when the carriage 34 is moved in the apparatus width direction. If the orientation of the carriage 34 is changed, the direction in which the ink is ejected is also changed, whereby recording quality on the medium may be lowered.

In the present embodiment, since the plural ink cartridges 42 are arranged along the apparatus depth direction in the carriage 34 as illustrated in FIG. 6, the centroid position in the apparatus width direction is not moved easily even if variation occurs in the residual amounts of the ink in the plural ink cartridges 42. Therefore, a change in orientation of the carriage 34 in the apparatus width direction can be reduced. As a result, the direction in which the ink is ejected can be stabilized and recording quality on the medium can be maintained.

Since the plural ink cartridges 42 are arranged along the apparatus depth direction in the carriage 34, the longitudinal direction of the ink cartridges 42 and the moving direction of the carriage 34 coincide with each other, whereby areas are large in which the ink can move freely in the ink cartridges 42. Therefore, the ink can be efficiently stirred while the carriage 34 is accelerated and decelerated.

A moving amount of the ink can be controlled by forming an ink accommodation space inside the ink cartridge 42 using a rib or a small chamber in consideration of a shift of the centroid position in the moving direction of the carriage 34. Therefore, since deposited pigments in the ink can be stirred, an effect of keeping concentration of pigment ink uniform can be expected in which deposition of pigments occurs especially easily.

Since the plural ink cartridges 42 are arranged along the apparatus depth direction in the carriage 34, the carriage 34 can be reduced in size in the apparatus width direction and, therefore, an increase in size of the printer 10 in the apparatus width direction can be reduced.

Relationship Between Operating Portion and Housing

Next, a relationship between the housing 12 and the carriage 34 will be described with reference to FIGS. 14 to 18. As illustrated in FIGS. 14 and 15, a cover portion 74 is provided on an inner wall surface 12*a* at a right end portion of the housing 12 in the apparatus width direction. As illustrated in FIG. 14, the cover portion 74 projects to the left in the apparatus width direction from the inner wall surface 12*a* at the right end portion of the housing 12 and extends along the apparatus depth direction. The cover portion 74 functions also as a rib which increases intensity of the inner wall surface 12*a* at the right end portion of the housing 12.

In the present embodiment, the operating portion 60 in the carriage 34 is provided on the side of the home position in the apparatus width direction. Therefore, in a state where the carriage 34 is located at the position of the right end portion of the housing 12 in the apparatus width direction, i.e., at the home position, the operating portion 60 in the carriage 34, i.e., at least a part of the levers 60*a*, is covered with the cover portion 74 located above the operating portion 60 in the apparatus height direction. That is, the cover portion 74 and at least a part of the levers 60*a* overlap in the apparatus width direction.

As illustrated in FIG. 15, in the present embodiment, the operating portion 60 and the cover portion 74 are located at positions lower than the top 42*b* of the ink cartridge 42 in the apparatus height direction. In the present embodiment, a distance between the operating portion 60 and the inner wall surface 12*a* at the right end portion of the housing 12 in the apparatus width direction is determined not to allow a user to reach the operating portion 60 and to operate the operating portion 60, i.e., the levers 60*a*.

Therefore, in a state where the carriage 34 is located at the home position in the housing 12, even if the user tries to operate the levers 60*a*, the user cannot access the operating portion 60 because of the existence of the cover portion 74 or because of the too small space to operate the operating portion 60. Therefore, in a state where the carriage 34 is located at the home position, improper operations of the operating portion 60 can be prevented or reduced. Further, a removal of the ink cartridge 42 at improper timing can be prevented or reduced. Therefore, damage to the information storage portion 72 and the contact terminal 62 can be prevented.

In the present embodiment, when replacing the ink cartridge 42 attached to the carriage 34, the control unit 52 moves the carriage 34 in the apparatus width direction from the home position to an ink cartridge replacement position illustrated in FIG. 16. In the present embodiment, at the ink cartridge replacement position illustrated in FIG. 16, the distance between the operating portion 60 and the inner wall surface 12*a* at the right end portion of the housing 12 is determined to allow the user to reach the operating portion 60. That is, the distance is determined to enable the operation of the operating portion 60.

Next, as illustrated in FIGS. 17 and 18, a cover portion 76 is provided in an inner wall surface 12*b* at the left end portion of the housing 12 in the apparatus width direction as well. As illustrated in FIG. 17, the cover portion 76 projects to the right in the apparatus width direction from the inner wall surface 12*b* at the left end portion of the housing 12 and extends along the apparatus depth direction. The cover portion 76 functions also as a rib which increases intensity of the inner wall surface 12*b* at the left end portion of the housing 12. Since the cover portions 74 and 76 are provided in the housing 12 symmetrically in the apparatus width direction, misoperations of the operating portion 60 in the printer 10 can be prevented and, at the same time, design properties can be increased.

For example, in a case where the operating portion 60 is provided at the left end portion of the carriage 34 in the apparatus width direction, since the cover portion 76 is located above the operating portion 60 in the apparatus height direction when the carriage 34 is located at the left end portion in the moving region B in the apparatus width direction, it becomes difficult to operate the operating portion 60. As a result, improper operations of the operating portion 60 can be prevented or reduced.

Modification of Embodiment (1) In the present embodiment, the operating portion 60 is provided at the right end portion of the carriage 34 in the apparatus width direction, i.e., on the side of the home position. Alternatively, the operating portion 60 may be provided at the left end portion of the carriage 34 in the apparatus width direction, i.e., on the side on which the first connecting portion 68A and the second connecting portion 68B are provided in the apparatus width direction.

(2) In the present embodiment, in a state where the carriage 34 is located at the home position, the cover portion 74 covers the operating portion 60 above the operating portion 60 in the apparatus height direction. In an alternative configuration in which no cover portion 74 is provided, in a state where the carriage 34 is located at the home position, a distance between the operating portion 60 and the inner wall surface 12*a* at the right end portion of the housing 12 may be determined so that a user cannot operate the operating portion 60. With this configuration, improper operations of the operating portion 60 can be prevented or reduced.

(3) In the present embodiment, the contact terminal 62 is provided on the side of the operating portion 60 in the apparatus width direction. Alternatively, the contact terminal 62 may be provided on the side of the first connecting portion 68A and the second connecting portion 68B in the apparatus width direction.

Second Embodiment

An operating portion 78 according to a second embodiment will be described with reference to FIGS. 19 and 20. The operating portion 78 includes plural levers 80. Each lever 80 includes an upper surface 80*a* extending in the apparatus width direction, and an inclined surface 80*b* inclinedly extending to the outside in the moving direction of the carriage 34 in the apparatus width direction, e.g., toward a home position, and downward in the apparatus height direction. The inclined surface 80*b* includes a recess 80*c* with which a user easily presses the lever 80 with a finger. The recess 80*c* is formed in a shape to fit a thick of a finger of the user. FIG. 19 illustrates a state where the carriage 34 is located at a replacement position of an ink cartridge 42 in the apparatus width direction as an example.

As illustrated in FIG. 19, the lever 80 projects from the carriage 34 to a position near a top 42*b* of the ink cartridge 42 in an apparatus height direction. When the lever 80 is seen from the front side in the apparatus depth direction, the inclined surface 80*b* is longer than the upper surface 80*a*. An inclination angle of the inclined surface 80*b* is determined to be gentle with respect to the apparatus height direction so that the inclined surface 80*b* is easily visible from above in the apparatus height direction. Therefore, when the lever 80 is seen from above in the apparatus height direction, visibility of the upper surface 80*a* and the inclined surface 80*b* improves. When the inclined surface 80*b* is pressed, the lever 80 releases fixation of the ink cartridge 42 to the carriage 34. Specifically, when the inclined surface 80*b* is pressed toward the ink cartridge 42 in the apparatus width direction, fixation of the ink cartridge 42 to the carriage 34 is released.

Since the inclined surface 80*b* is longer than the upper surface 80*a* when the lever 80 is seen from the front side in the apparatus depth direction as described above, the user can recognize the inclined surface 80*b* more clearly when releasing fixation of the ink cartridge 42 to the carriage 34, and can operate the lever 80 by properly hooking the finger on the inclined surface 80*b*. With this configuration, misoperations of the lever 80 (e.g., inadvertent pressing of the upper surface 80*a* of the lever 80) can be reduced and fixation of the ink cartridge 42 to the carriage 34 can be released reliably.

The above description will be summarized below. The printer 10 is provided with the carriage 34 which includes the recording head 36 which records on a medium and which is movable in the apparatus width direction as a predetermined direction. The carriage 34 includes plural removable ink cartridges 42 which contain ink to be ejected from the recording head 36, and the operating portion 60 which performs operation to release fixation of the ink cartridges 42 to the carriage 34. The plural ink cartridges 42 are provided in the carriage 34 to be arranged along the apparatus depth direction which crosses the apparatus width direction which is the moving direction of the carriage 34, and the operating portion 60 is located outside the ink cartridge 42 in the apparatus width direction which is the moving direction of the carriage 34.

With the configuration described above, since the plural ink cartridges 42 are arranged in the carriage 34 along the apparatus depth direction which crosses the apparatus width direction which is the moving direction of the carriage 34, the size in the width direction can be reduced and, since the operating portion 60 is located outside the ink cartridge 42 in the apparatus width direction which is the moving direction of the carriage 34, in a state where the carriage 34 is located at the end portion of the moving region B, e.g., at the home position, a space for the user operating the operating portion 60 becomes small. That is, in a state where the carriage 34 is located at the end portion of the moving region B, it is difficult for the user to operate the operating portion 60. Therefore, removal of the ink cartridge 42 at improper timing can be prevented or reduced.

The operating portion 78 includes the upper surface 80*a* and the inclined surface 80*b* extending from the upper surface 80*a* to the outside in the moving direction of the carriage 34 and downward in the apparatus height direction. Fixation of the ink cartridge 42 to the carriage 34 is released when the inclined surface 80*b* is pressed. When seen from the apparatus depth direction which crosses the moving direction of the carriage 34, the inclined surface 80*b* is longer than the upper surface 80*a*. With this configuration, it enables the user to recognize more clearly that the inclined surface 80*b* is a portion to hook the finger on. When the user hooks the finger on the inclined surface 80*b* and operates the operating portion 78, the inclined surface 80*b* guides the direction in which the finger presses. Therefore, fixation of the ink cartridge 42 to the carriage 34 can be released properly. Thereby, misoperations, such as pressing the upper surface 80*a* of the operating portion 78 with the finger, can be reduced.

The housing 12 including the carriage 34 thereinside has the cover portions 74 and 76 which cover the upper portion of the operating portion 60 when the carriage 34 is located at the end portions of the moving region B. With this configuration, in a state where the carriage 34 is located at the end portion of the moving region B, it is more difficult for the user to operate the operating portion 60. Therefore, removal of the ink cartridge 42 at improper timing can be prevented or reduced more reliably.

The operating portion 60 and the cover portion 74 are located at positions lower than the top 42*b* of the ink cartridge 42. With this configuration, an increase in the size in the apparatus height direction due to the cover portion 74 can be avoided.

In a state where the carriage 34 is located at the end portion of the moving region B, i.e., at the home position, the distance between the inner wall surface 12*a* of the housing 12 including the carriage 34 thereinside and the operating portion 60 is determined to prevent operations of the operating portion 60. With this configuration, removal of the ink cartridge 42 at improper timing can be prevented or reduced more reliably. The distance between the inner wall surface 12*a* of the housing 12 and the operating portion 60 is determined to prevent operations of the operating portion 60 and to prevent the user from reaching the operating portion 60. Here, the distance is determined in consideration of the average size of a finger of a user. If the distance between the inner wall surface 12*a* of the housing 12 and the operating portion 60 is determined to prevent operations of the operating portion 60, it is not necessary to provide the cover portion 74 described with reference to FIG. 14.

The operating portion 60 is provided on the side of the home position of the carriage 34. With this configuration, improper removal of the ink cartridge 42 by the user can be reduced when the carriage 34 is located at the home position.

The ink cartridge 42 includes the information storage portion 72 which holds information about the ink cartridge 42. The contact terminal 62 which is in electrical contact with the information storage portion 72 in the carriage 34 is disposed on the side of the operating portion 60 in the apparatus width direction which is the moving direction of the carriage 34.

The ink cartridge 42 includes the information storage portion 72 which holds information about the ink cartridge 42. The carriage 34 includes the first connecting portion 68A and the second connecting portion 68B to which the cable 70 is connected. The contact terminal 62 which is in electrical contact with the information storage portion 72 in the carriage 34 is disposed on the side on which the first connecting portion 68A and the second connecting portion 68B are provided in the apparatus width direction which is the moving direction of the carriage 34.

With this configuration, since the carriage 34 includes the first connecting portion 68A and the second connecting portion 68B to which the cable 70 is connected, and the contact terminal 62 which is in electrical contact with the information storage portion 72 in the carriage 34 is disposed on the side on which the first connecting portion 68A and the second connecting portion 68B are provided in the apparatus width direction which is the moving direction of the carriage 34, a distance between the contact terminal 62 and the first connecting portion 68A and the second connecting portion 68B becomes short (that is, a wire length can be shortened) inside the carriage 34, whereby the cost can be reduced.

Although the carriage 34 and the cover portions 74 and 76 according to the invention are applied to an ink jet printer as an example of recording apparatus in the present embodiment, the carriage 34 and the cover portions 74 and 76 may be applied to any other liquid ejecting apparatuses. The liquid ejecting apparatus here is not limited to recording apparatuses, such as a printer, a copier, and a facsimile machine, in which an ink jet recording head is used to eject ink from the recording head and record on a recording medium. The liquid ejecting apparatus may also include an apparatus which ejects a liquid having applications of ink instead of ink on a medium which receives the ejected liquid that corresponds to a recording medium from a liquid ejecting head that corresponds to an ink jet recording head and makes the liquid adhere to the medium which receives the ejected liquid.

Other than the recording head described above, a liquid ejecting head may include a coloring material ejecting head used for manufacturing a color filter of a liquid crystal display etc., an electrode material (conductive paste) ejecting head used for forming an electrode of an organic electroluminescence (EL) display and a field emission display (FED), a bioorganic material ejecting head used for manufacturing a biochip, and a sample ejecting head as a precision pipette, etc.

The invention is not limited to the above embodiments and various changes may be made without departing from the scope of the invention described in the claims which are within the scope of the invention.

The entire disclosure of Japanese Patent Application No. 2016-035342, filed Feb. 26, 2016 and 2016-121439, filed Jun. 20, 2016 are expressly incorporated by reference herein.

What is claimed is:

1. A recording apparatus, comprising a carriage that includes a recording head for recording on a medium and that is movable in a predetermined direction, wherein the carriage has fixed thereto plural ink cartridges that contain liquids to be ejected from the recording head, and an operating portion that performs an operation to release the ink cartridges fixed to the carriage, and wherein the ink cartridges are arranged in a depth direction of the recording apparatus that is perpendicular to the predetermined direction, and the operating portion is located outside the ink cartridges in the predetermined direction of the carriage, wherein a housing including the carriage thereinside has a cover portion that covers an upper portion of the operating portion in a state where the carriage is located at an end portion of a moving region.

2. The recording apparatus according to claim 1, wherein the operating portion and the cover portion are located at positions lower than a top portion of the ink cartridges.

3. The recording apparatus according to claim 1, wherein, in a state where the carriage is located at the end portion of the moving region, a distance between an inner wall surface of the housing and the operating portion is determined to prevent operations of the operating portion.

4. The recording apparatus according to claim 1, wherein the operating portion is provided on the side of a home position of the carriage.

5. The recording apparatus according to claim 1, wherein the operating portion includes an upper surface and an inclined surface extending from the upper surface to the outside in the predetermined direction and downward in an apparatus height direction, wherein the ink cartridges attached to the carriage is released when the inclined surface is pressed, and wherein a length of the inclined surface is longer than a length of the upper surface in the depth direction.

6. The recording apparatus according to claim 1, wherein each of the ink cartridges includes a storage medium that holds information about the ink cartridge, and wherein a contact terminal which is in electrical contact with the storage medium in the carriage is disposed on the side of the operating portion in the predetermined direction.

7. The recording apparatus according to claim 1, wherein each of the ink cartridges includes a storage medium that holds information about the ink cartridge, wherein the carriage includes a connecting portion to which a cable is connected, and wherein a contact terminal which is in electrical contact with the storage medium in the carriage is disposed on the side on which the connecting portion is provided in the predetermined direction.

8. A recording apparatus, comprising:

a carriage that includes a recording head for recording on a medium and that is movable in a moving direction, wherein the carriage has fixed thereto plural ink cartridges that contain liquids to be ejected from the recording head, and an operating portion that performs an operation to release the ink cartridges fixed to the carriage, and wherein each of the fixed ink cartridges are arranged such that a longest side of the ink cartridges is along the moving direction when viewed from above of the carriage, and the operating portion is located outside the ink cartridges in the moving direction, wherein a width of the carriage in the moving direction is shorter than a depth of the carriage in a direction crossing the moving direction, the width of the carriage corresponding to the longest side of the fixed ink cartridges and the depth of the carriage corresponding to a total of the shortest sides of the fixed ink cartridges.

9. The recording apparatus according to claim 8, wherein the fixed ink cartridges are arranged in a depth direction of the recording apparatus that is perpendicular to the moving direction, and the operating portion is located outside the ink cartridges in the moving direction, wherein the depth direction is a transportation direction of the medium from a feed port to a discharge port of the recording apparatus.

10. A recording apparatus, comprising:

a carriage that includes a recording head for recording on a medium and that is movable in a moving direction, wherein the carriage has fixed thereto at least five fixed ink cartridges that contain liquids to be ejected from the recording head, and, wherein a total of the shortest side of the fixed at least five ink cartridges arranged the carriage is longer than a longest side of each of the fixed at least five ink cartridges, and wherein each of the fixed at least five ink cartridges are arranged such that a longest side of the ink cartridges is along the moving direction when viewed from above of the carriage, wherein a width of the carriage in the moving direction is shorter than a depth of the carriage in a direction crossing the moving direction, the width of the carriage corresponding to the longest side of the fixed at least five ink cartridges and the depth of the carriage corresponding to a total of the shortest sides of the fixed at least five ink cartridges.

* * * * *